US008943849B2

(12) United States Patent
Takata et al.

(10) Patent No.: US 8,943,849 B2
(45) Date of Patent: Feb. 3, 2015

(54) AIR-CONDITIONING APPARATUS

(75) Inventors: Shigeo Takata, Tokyo (JP); Kouji Yamashita, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 694 days.

(21) Appl. No.: 13/202,195

(22) PCT Filed: Mar. 23, 2009

(86) PCT No.: PCT/JP2009/055575

§ 371 (c)(1),
(2), (4) Date: Aug. 18, 2011

(87) PCT Pub. No.: WO2010/109571

PCT Pub. Date: Sep. 30, 2010

(65) Prior Publication Data

US 2011/0297363 A1 Dec. 8, 2011

(51) Int. Cl.
*F25D 25/00* (2006.01)
*F25B 7/00* (2006.01)
(Continued)

(52) U.S. Cl.
CPC . *F24F 3/06* (2013.01); *F25B 13/00* (2013.01); *F25B 25/005* (2013.01); *F25B 49/02* (2013.01);
(Continued)

(58) Field of Classification Search
CPC ..... F24F 2011/0045; F24F 3/06; F24F 2011/0052; F25B 30/02
USPC ..... 62/202, 79, 98, 99, 118, 126, 129, 157, 62/160, 181, 183
See application file for complete search history.

(56) References Cited

U.S. PATENT DOCUMENTS 2,122,210 A * 6/1938 Miller ..... 62/191
4,387,578 A * 6/1983 Paddock ..... 62/127
(Continued)

FOREIGN PATENT DOCUMENTS

JP 62-084241 A 4/1987
JP 64-088054 A 4/1989
(Continued)

OTHER PUBLICATIONS

Japanese Office Action (Notification of Reason for Refusal) dated Nov. 6, 2012, issued in corresponding Japanese Patent Application No. 2011-505685, and English language translation of Office Action. (6 pages).
(Continued)

*Primary Examiner* — Marc Norman
*Assistant Examiner* — Henry Crenshaw
(74) *Attorney, Agent, or Firm* — Buchanan Ingersoll & Rooney PC

(57) ABSTRACT

An air-conditioning apparatus is provided with a heat-source device that supplies a refrigerant, a relay unit that exchanges heat of a heat medium such as water or anti-freezing fluid supplied from the heat-source device in an intermediate heat exchanger and supplies the heat medium, an indoor unit that exchanges heat between a use side heat exchanger through which the heat medium supplied from the relay unit flows and indoor air and performs cooling or heating in the indoor space, a controller that controls operations of the heat-source device, the relay unit and the indoor unit, and a third temperature sensor that detects the temperature of the heat medium flowing through the use side heat exchanger, and if an abnormality in at least one of the heat-source device and the relay unit is detected, the controller continues the operation of the indoor unit while the temperature detected by the third temperature sensor remains within a first predetermined temperature range.

15 Claims, 6 Drawing Sheets

(51) Int. Cl.

| | |
|---|---|
| ***F25B 1/00*** | (2006.01) |
| ***F25B 49/00*** | (2006.01) |
| ***G05D 23/32*** | (2006.01) |
| ***F24F 3/06*** | (2006.01) |
| ***F25B 13/00*** | (2006.01) |
| ***F25B 25/00*** | (2006.01) |
| ***F25B 49/02*** | (2006.01) |
| *F24F 11/00* | (2006.01) |

(52) U.S. Cl.

CPC . *F24F 2011/0045* (2013.01); *F24F 2011/0052* (2013.01); *F25B 2313/029* (2013.01); *F25B 2313/006* (2013.01); *F25B 2313/023* (2013.01); *F25B 2313/0272* (2013.01); *F25B 2313/02741* (2013.01)

USPC ..... 62/202; 62/79; 62/98; 62/115; 62/126; 62/157

(56) References Cited

U.S. PATENT DOCUMENTS

| | | | | | |
|---|---|---|---|---|---|
| 4,441,329 | A | * | 4/1984 | Dawley | 62/126 |
| 4,845,956 | A | * | 7/1989 | Berntsen et al. | 62/225 |
| 5,090,210 | A | * | 2/1992 | Katayanagi et al. | 62/135 |
| 5,351,498 | A | * | 10/1994 | Takahashi et al. | 62/99 |
| 5,477,696 | A | * | 12/1995 | Takahata et al. | 62/148 |
| 5,555,269 | A | * | 9/1996 | Friday et al. | 714/704 |
| 6,651,450 | B1 | * | 11/2003 | Tamegai et al. | 62/133 |
| 2002/0134097 | A1 | * | 9/2002 | Ichikawa et al. | 62/228.3 |
| 2003/0136133 | A1 | * | 7/2003 | Schicke | 62/62 |
| 2007/0079619 | A1 | | 4/2007 | Hamada et al. | |
| 2009/0183519 | A1 | * | 7/2009 | Nishikawa et al. | 62/132 |

FOREIGN PATENT DOCUMENTS

| | | | | | |
|---|---|---|---|---|---|
| JP | 2-118372 | A | | 5/1990 | |
| JP | 2003-322388 | A | | 11/2003 | |
| JP | 2003-343936 | A | | 12/2003 | |
| JP | 2003343936 | A | * | 12/2003 | F25B 13/00 |
| JP | 2004-108717 | A | | 4/2004 | |
| JP | 2004-205118 | A | | 7/2004 | |
| JP | 2005-207700 | A | | 8/2005 | |
| JP | 2007-040554 | A | | 2/2007 | |
| JP | 2007-187406 | A | | 7/2007 | |
| JP | 2007187406 | A | * | 7/2007 | |
| JP | 2007-232267 | A | | 9/2007 | |
| JP | 2009-052769 | A | | 3/2009 | |

OTHER PUBLICATIONS

Extended European Search Report issued by the European Patent Office on Apr. 18, 2013, in the corresponding European Patent Application No. 09842187.8 (5 pages).

Office Action (Notice of Reasons for Rejection) dated Jun. 18, 2013, issued by the Japanese Patent Office in the corresponding Japanese Patent Application No. 2011-505685 and an English translation thereof. (4 pages).

International Search Report (PCT/ISA/210) issued on Jun. 23, 2009, by Japanese Patent Office as the International Searching Authority for International Application No. PCT/JP200/055575.

Chinese Office Action ((Notification of the First Office Action) dated Jul. 2, 2013, issued in corresponding Chinese Application No. 2009801582632, and an English Translation of the Office Action. (14 pgs.).

Office Action (Notification of the Second Office Action) issued on Feb. 11, 2014, by the Chinese Patent Office in corresponding Chinese Patent Application No. 200980158263.2, and an English Translation of the Office Action. (15 pages).

* cited by examiner

AIR-CONDITIONING APPARATUS

TECHNICAL FIELD

The present invention relates to an air-conditioning apparatus applied to a multiple-unit air-conditioning apparatus for a building and the like.

BACKGROUND ART

As a prior-art air-conditioning apparatus applied to a multi air-conditioning apparatus for a building, an air-conditioning apparatus is proposed in which, for example, "(1) is a compressor; (2) is a four-way valve that switches a refrigerant flowing direction of a heat-source unit; (3) is a heat-source-unit-side heat exchanger; and (4) is an accumulator which is connected to the devices (1) to (3) and constitutes a heat source unit (A). (5) are three indoor heat exchangers; (6) is a first connection pipeline that connects the four-way valve (2) of the heat source unit (A) to a relay unit (E); (6b), (6c), and (6d) are first connection pipelines on the indoor unit side that connect the indoor heat exchangers (5) of indoor units (B), (C), and (D), respectively, to the relay unit (E) and correspond to the first connection pipeline (6); (7) is a second connection pipeline that connects the heat-source-unit-side heat exchanger (3) of the heat source unit (A) to the relay unit (E); (7b), (7c), and (7d) are second connection pipelines on the indoor unit side that connect the indoor heat exchangers (5) of the indoor units (B), (C), and (D), respectively, to the relay unit (E) and correspond to the second connection pipeline (7); (8) is a three-way switching valve that connects the first connection pipelines (6b), (6c), and (6d) on the indoor unit side to the first connection pipeline (6) or the second connection pipeline (7) side capable of switching; and (9) is a first flow-rate controller connected close to the indoor heat exchangers (5) and controlled by a superheat amount during cooling and a subcool amount during heating on the outlet side of the heat exchanger (5) and is connected to the second connection pipelines (7b), (7c), and (7d) on the indoor unit side. (10) is a first branch portion constituted by the first connection pipelines (6b), (6c), and (6d) on the indoor unit side and the three-way switching valve (8) switchably connected to the first connection pipeline (6) or the second connection pipeline (7); (11) is a second branch portion constituted by the second connection pipelines (7b), (7c), and (7d) on the indoor unit side and the second connection pipeline (7); and (12) is an openable second flow-rate controller that connects the first branch portion (10) and the second branch portion (11) of the second connection pipeline (7)." (See Patent Document 1, for example).

[Patent Document 1] Japanese Unexamined Patent Application Publication No. 2-118372 (page 3, FIG. 1)

DISCLOSURE OF INVENTION

Problems to be Solved by the Invention

In the prior-art air-conditioning apparatus as described above, a refrigerant, which changes in two phases and is supplied to a relay unit (relay machine) from a heat-source device (heat source machine), branches in the relay unit. The refrigerant having branched in the relay unit flows into a use side heat exchanger of the respective indoor units and performs cooling or heating of an indoor space. That is, the prior-art air-conditioning apparatus is configured such that the refrigerant supplied from the heat-source device flows into the indoor unit (use side heat exchanger). Thus, if an abnormality occurs in any one of the units (the heat-source device, the relay unit and the indoor units) constituting the air-conditioning apparatus, secondary abnormality caused by the first abnormality soon occurs in the other units. Therefore, if an abnormality (such as an abnormality in a refrigerant cycle in the unit, a communication failure between the units, and the like) is detected in any one of the units (the heat-source device, the relay unit, and the indoor units), there has been a problem in that the unit in which the abnormality is detected must be stopped, and the other units must be also stopped immediately. Therefore, if an abnormality occurs in the heat-source device or the relay unit, for example, a cooling operation or a heating operation of the indoor units must be stopped immediately.

The present invention was made to solve the above-described problem and an object thereof is to obtain an air-conditioning apparatus that can delay stoppage of the other units even if an abnormality occurs in any one of the units constituting the air-conditioning apparatus.

Means for Solving the Problems

The air-conditioning apparatus according to the present invention is provided with a heat-source device that supplies a refrigerant that changes in two phases or a refrigerant in a supercritical state; at least one relay unit that exchanges heat between the refrigerant supplied from the heat-source device and a heat medium such as water or anti-freezing fluid different from the refrigerant in an intermediate heat exchanger and supplies the heat medium; at least one indoor unit that exchanges heat between the heat medium supplied from the relay unit and air of a region to be air-conditioned in a use side heat exchanger and performs cooling or heating in region to be air-conditioned; a controller that controls operations of the heat-source device; the relay unit and the indoor unit; and a first temperature detection portion that detects the temperature of the heat medium flowing through the use side heat exchanger; and if an abnormality in at least one of the heat-source device and the relay unit is detected, the controller continues the operation of the indoor unit while the temperature detected by the first temperature detection portion remains within a first predetermined temperature range.

Also, the air-conditioning apparatus according to the present invention is provided with a heat-source device that supplies a refrigerant that changes in two phases or a refrigerant in a supercritical state; at least one relay unit that exchanges heat between the refrigerant supplied from the heat-source device and a heat medium such as water or anti-freezing fluid different from the refrigerant in an intermediate heat exchanger and supplies the heat medium; at least one indoor unit that exchanges heat between the heat medium supplied from the relay unit and air of a region to be air-conditioned in a use side heat exchanger and performs cooling or heating in the region to be air-conditioned; a first controller that controls operations of the heat-source device and the relay unit; a second controller that controls an operation of the indoor unit; and a first temperature detection portion that detects the temperature of the heat medium that flows through the use side heat exchanger; and if an abnormality occurs in communication with the first controller, the second controller continues the operation of the indoor unit while the temperature detected by the first temperature detection portion remains within a first predetermined temperature range.

Advantages

In the present invention, a heat medium different from the refrigerant supplied from the heat-source device is configured to flow into the indoor unit (use side heat exchanger). By employing such a configuration, the heat medium can store a given amount of heat capacity. That is, the heat medium functions as a buffer. Thus, even if an abnormality occurs in the heat source machine or the relay unit, for example, the temperature of the heat medium having flowed into the indoor unit does not change immediately. Therefore, even if an abnormality in the heat source machine or the relay unit is detected, by continuing the operation of the indoor unit while the temperature detected by the first temperature detection portion is within the first predetermined temperature range, stoppage of the indoor unit can be delayed.

Also, since the temperature of the heat medium having flowed into the indoor unit as described above does not change immediately, even if an abnormality occurs in communication between the units, for example, by continuing the operation of the indoor unit while the temperature detected by the first temperature detection portion is within the first predetermined temperature range, stoppage of the indoor unit can be delayed.

REFERENCE NUMERALS

1 heat-source device (outdoor unit), 2 indoor unit, 2*a*, indoor unit, 2*b* indoor unit, 2*c* indoor unit, 2*d* indoor unit, 3 relay unit, 3*a*, first relay unit, 3*b* second relay unit, 4 refrigerant pipeline, 4*a* first connection pipeline, 4*b* second connection pipeline, 5 pipeline, 5*a* pipeline, 5*b* pipeline, 6 outdoor space, 7 living space, 9 building, 10 compressor, 11 four-way valve, 12 heat-source-side heat exchanger, 13*a* check valve, 13*b* check valve, 13*c* check valve, 13*d* check valve, 14 gas-liquid separator, 15 intermediate heat exchanger, 15*a*, first intermediate heat exchanger, 15*b* second intermediate heat exchanger, 16 expansion valve, 16*a* expansion valve, 16*b* expansion valve, 16*c* expansion valve, 16*d* expansion valve, 16*e* expansion valve, 17 accumulator, 21 pump, 21*a* first pump, 21*b* second pump, 22 channel switching valve, 22*a* channel switching valve, 22*b* channel switching valve, 22*c* channel switching valve, 22*d* channel switching valve, 23 channel switching valve, 23*a* channel switching valve, 23*b* channel switching valve, 23*c* channel switching valve, 23*d* channel switching valve, 24 stop valve, 24*a* stop valve, 24*b* stop valve, 24*c* stop valve, 24*d* stop valve, 25 flow control valve, 25*a* flow control valve, 25*b* flow control valve, 25*c* flow control valve, 25*d* flow control valve, 26 use side heat exchanger, 26*a* use side heat exchanger, 26*b* use side heat exchanger, 26*c* use side heat exchanger, 26*d* use side heat exchanger, 27 bypass, 27*a* bypass, 27*b* bypass, 27*c* bypass, 27*d* bypass, 31 first temperature sensor, 31*a* first temperature sensor, 31*b* first temperature sensor, 32 second temperature sensor, 32*a* second temperature sensor, 32*b* second temperature sensor, 33 third temperature sensor, 33*a* third temperature sensor, 33*b* third temperature sensor, 33*c* third temperature sensor, 33*d* third temperature sensor, 34 fourth temperature sensor, 34*a* fourth temperature sensor, 34*b* fourth temperature sensor, 34*c* fourth temperature sensor, 34*d* fourth temperature sensor, 35 fifth temperature sensor, 36 pressure sensor, 37 sixth temperature sensor, 38 seventh temperature sensor, 39 pressure sensor, 40 pressure sensor, 50 non-living space, 61 controller, 62 controller, 62*a* controller, 62*b* controller, 62*c* controller, 62*d* controller, 63*a* controller, 63*b* controller, 100 air-conditioning apparatus.

BEST MODES FOR CARRYING OUT THE INVENTION

Figure 1:
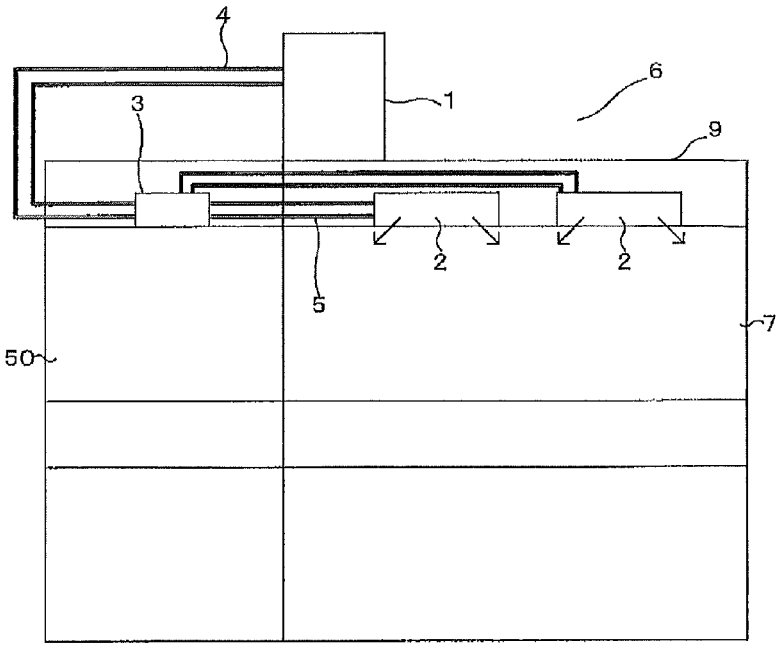
FIG. 1 is an entire configuration diagram illustrating an example of an installed state of an air-conditioning apparatus according to an embodiment.
Figure 2:
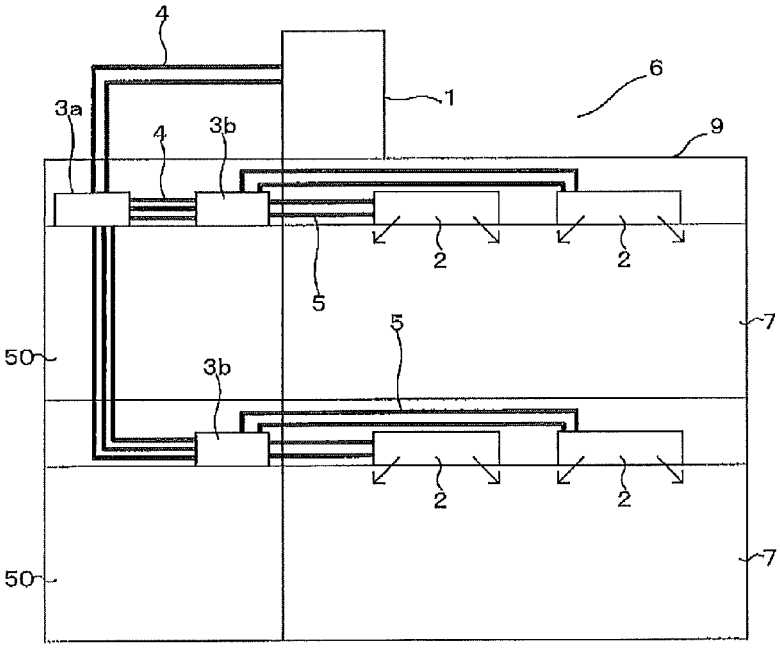
FIG. 2 is an entire configuration diagram illustrating an example of an installed state of an air-conditioning apparatus according to the embodiment.

FIGS. 1 and 2 are entire configuration diagrams illustrating an example of an installed state of an air-conditioning apparatus according to an embodiment of the present invention. On the basis of FIGS. 1 and 2, a configuration of the air-conditioning apparatus will be described. This air-conditioning apparatus performs a cooling operation or a heating operation using a refrigeration cycle (a refrigeration cycle and a heat-medium circulation circuit) through which a refrigerant (a heat-source-side refrigerant and a heat medium (water, anti-freezing fluid and the like)) is circulated. In the following drawings including FIG. 1, the relationship among the sizes of constituent members might be different from the actual one.

As shown in FIG. 1, this air-conditioning apparatus has a single heat-source device 1 as a heat-source machine, a plurality of indoor units 2, and a relay unit 3 located between the heat-source device 1 and the indoor units 2. The heat-source device 1 supplies heat-source-side refrigerant to the relay unit 3. The relay unit 3 exchanges heat between the heat-source-side refrigerant and the heat medium and supplies a heat medium to each of the indoor units 2. The indoor units 2 perform cooling or heating of the inside of a room such as a living space 7 or the like. The heat-source device 1 and the relay unit 3 are connected by a refrigerant pipeline 4 through which the heat-source-side refrigerant is guided. The relay unit 3 and the indoor units 2 are connected by a pipeline 5 through which the heat medium is guided so that cooling energy or heating energy generated in the heat-source device 1 is delivered to the indoor units 2. The connected numbers of the heat-source devices 1, the indoor units 2, and the relay units 3 are not limited to those illustrated in the figure.

The heat-source device 1 is usually arranged in an outdoor space 6, which is a space outside a building 9 such as a building. The indoor unit 2 is arranged in a living space 7 inside the building 9 such as a living room or a server room to which air for cooling or air for heating can be conveyed and supplies the air for cooling or the air for heating to the living space 7 to become a region to be air-conditioned. The relay unit 3 is formed in such a manner that it can be installed at a position different from the outdoor space 6 and the living space 7 (hereinafter referred to as a non-living space 50) as a separate body from the heat-source device 1 and the indoor unit 2, connects the heat-source device 1 and the indoor unit 2 to each other, and transfers cooling energy or heating energy supplied from the heat-source device 1 to the indoor unit 2.

The outdoor space 6 is assumed to be a place outside the building 9, a place on the roof as shown in FIG. 1, for example. The non-living space 50 is assumed to be a space inside the building 9 but different from the living space 7, a place where people are not present all the time such as on a corridor, a space in a ceiling of a common zone, a common portion with an elevator or the like, a machine room, a computer room, a warehouse or the like, for example. Also, the living space 7 is assumed to be a place inside the building 9 and where people are present all the time or a large or a small number of people are present even temporarily, an office, a classroom, a meeting room, a dining room, a server room or the like, for example.

The heat-source device 1 and the relay unit 3 are connected to each other using two refrigerant pipelines 4. Also, the relay unit 3 and each indoor unit 2 are connected to each other by two pipelines 5, respectively. As described above, by connecting the heat-source device 1 to the relay unit 3 by the two refrigerant pipelines 4 and by connecting the indoor unit 2 to the relay unit 3 by the two pipelines 5, construction of the air-conditioning apparatus is facilitated.

As illustrated in FIG. 2, the relay unit 3 may be formed so as to be divided into one first relay unit 3*a* and two second relay units 3*b* branching off from the first relay unit 3*a*. By using the above configuration, a plurality of the second relay units 3*b* can be connected to the one first relay unit 3*a*. In this configuration, the number of the refrigerant pipelines 4 between the first relay unit 3*a* and the second relay units 3*b* is three. Details of this pipeline path will be described later.

In FIGS. 1 and 2, the indoor unit 2 is illustrated as a ceiling cassette type as an example, but not limited to that, and any type can be used as long as it is formed in such a manner as to be capable of blowing out cooling energy or heating energy directly or through a duct to the living space 7 such as a ceiling-concealed type, a ceiling suspended type and the like.

Also, in FIG. 1, an example in which the heat-source device 1 is installed in the outdoor space 6 is shown, but is not limited to that. For example, the heat-source device 1 may be installed in a closed-off space such as a machine room with a ventilation port and the like, may be installed inside the building 9 if waste heat can be exhausted to the outside of the building 9 by an exhaust air duct or may be also installed inside the building 9 if the heat-source device 1 of a water-cooled type is used. If the heat-source device 1 is installed in such a place, no particular problem would occur.

Also, the relay unit 3 may be installed in the vicinity of the heat-source device 1. However, if the distance from the relay unit 3 to the indoor unit 2 is very large, conveying power for the heat medium becomes considerably large, which reduces an effect of energy saving.

Figure 3:
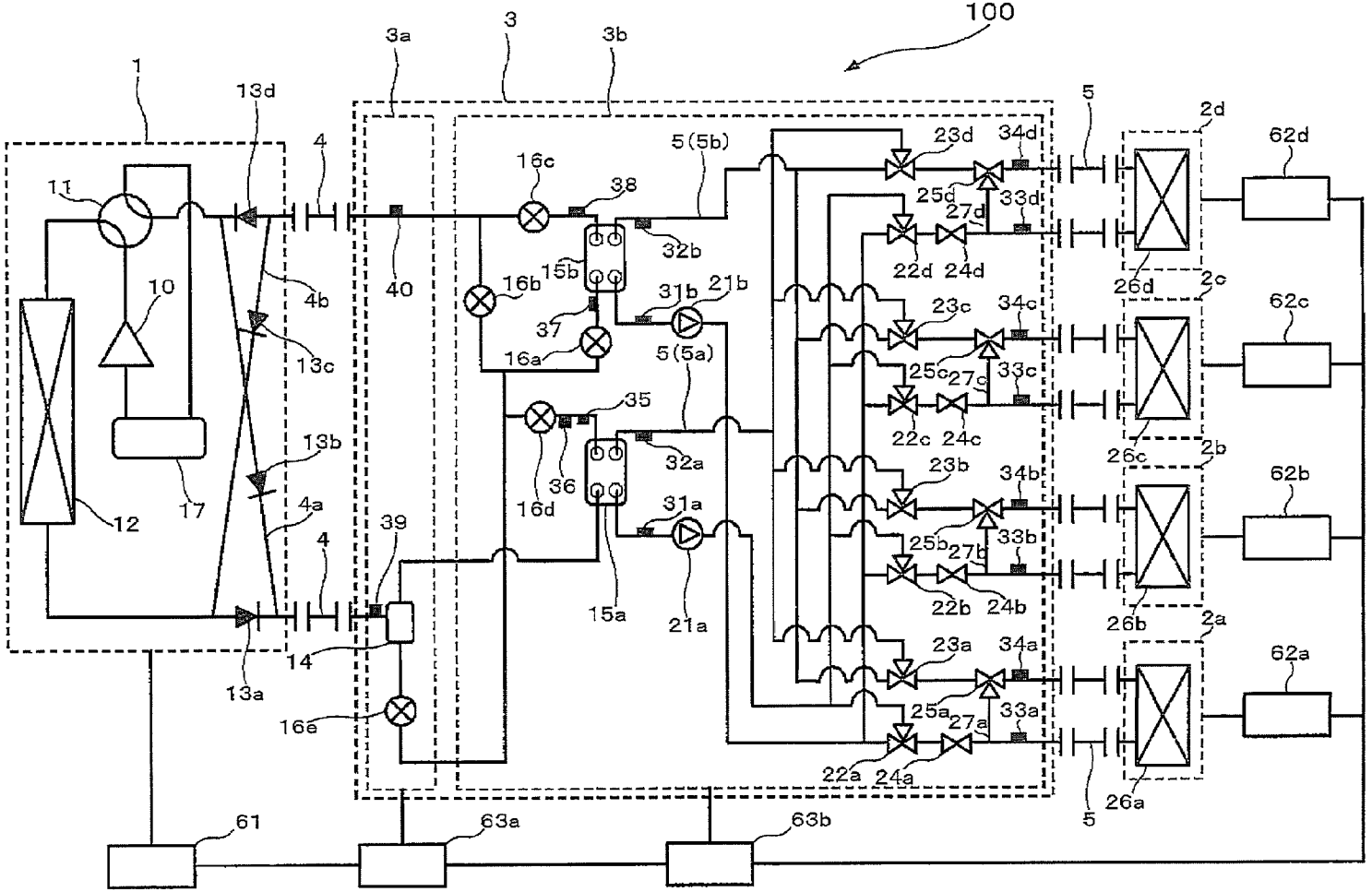
FIG. 3 is an outline circuit diagram illustrating configuration of an air-conditioning apparatus.

FIG. 3 is an outline circuit diagram illustrating a configuration of the air-conditioning apparatus 100. On the basis of FIG. 3, the detailed configuration of the air-conditioning apparatus 100 will be described. As shown in FIG. 3, the heat-source device 1 and the relay unit 3 are connected to each other through a first intermediate heat exchanger 15*a* and a second intermediate heat exchanger 15*b* provided in the second relay unit 3*b*. Both the relay unit 3 and the indoor unit 2 are connected through the first intermediate heat exchanger 15*a* and the second intermediate heat exchanger 15*b* provided in the second relay unit 3. A configuration and functions of each constituent device provided in the air-conditioning apparatus 100 will be described below. In FIG. 3 and thereafter, an example in which the relay unit 3 is divided into the first relay unit 3*a* and the second relay unit 3*b* is illustrated.

(Heat-Source Device 1)

In the heat-source device 1, a compressor 10, a four-way valve 11, a heat-source-side heat exchanger (outdoor heat exchanger) 12, and an accumulator 17 are connected in series by the refrigerant pipeline 4 and contained. Also, in the heat-source device 1, a first connection pipeline 4*a*, a second connection pipeline 4*b*, a check valve 13*a*, a check valve 13*b*, a check valve 13*c*, and a check valve 13*d* are provided. By providing the first connection pipeline 4*a*, the second connection pipeline 4*b*, the check valve 13*a*, the check valve 13*b*, the check valve 13*c*, and the check valve 13*d*, regardless of the operation required by the indoor unit 2, the flow of a heat-source-side refrigerant made to flow into the relay unit 3 can be directed in a certain direction.

The compressor 10 sucks the heat-source-side refrigerant, compresses the heat-source-side refrigerant and brings it into a high-temperature high-pressure state and can be constituted by an inverter compressor or the like capable of capacity control, for example. The four-way valve 11 switches a flow of the heat-source-side refrigerant during a heating operation between a flow of the heat-source-side refrigerant during a cooling operation. The heat-source-side heat exchanger 12 functions as an evaporator during the heating operation and functions as a condenser during the cooling operation, exchanges heat between air supplied from an air blower such as a fan, not shown, and the heat-source-side refrigerant and evaporates and gasifies or condenses and liquefies the heat-source-side refrigerant. The accumulator 17 is provided on the suction side of the compressor 10 and stores an excess refrigerant.

The check valve 13*d* is provided in the refrigerant pipeline 4 between the relay unit 3 and the four-way valve 11 and allows the flow of the heat-source-side refrigerant only in a predetermined direction (direction from the relay unit 3 to the heat-source device 1). The check valve 13*a* is provided in the refrigerant pipeline 4 between the heat-source-side heat exchanger 12 and the relay unit 3 and allows the flow of the heat-source-side refrigerant only in a predetermined direction (direction from the heat-source device 1 to the relay unit 3). The check valve 13*b* is provided in the first connection pipeline 4*a* and allows the flow of the heat-source-side refrigerant only in a direction from the upstream side of the check valve 13*d* to the upstream side of the check valve 13*a*. The check valve 13*c* is provided in the second connection pipeline 4*b* and allows the flow of the heat-source-side refrigerant only in a direction from the downstream side of the check valve 13*d* to the downstream side of the check valve 13*a*.

The first connection pipeline 4*a* connects the refrigerant pipeline 4 on the upstream side of the check valve 13*d* to the refrigerant pipeline 4 on the upstream side of the check valve 13*a* in the heat-source device 1. The second connection pipeline 4*b* connects the refrigerant pipeline 4 on the downstream side of the check valve 13*d* to the refrigerant pipeline 4 on the downstream side of the check valve 13*a* in the heat-source device 1. In FIG. 2, an example in which the first connection pipeline 4*a*, the second connection pipeline 4*b*, the check valve 13*a*, the check valve 13*b*, the check valve 13*c*, and the check valve 13*d* are provided is shown, but the configuration is not limited to this, and these components do not necessarily have to be provided.

(Indoor Unit 2)

In each of the indoor units 2, a use side heat exchanger 26 is mounted. This use side heat exchanger 26 is connected to a stop valve 24 and a flow control valve 25 of the second relay unit 3*b* through the pipeline 5. This use side heat exchanger 26 exchanges heat between the air supplied from the air blower such as a fan, not shown, and the heat medium and generates heating air or cooling air to be supplied to the region to be air-conditioned.

In FIG. 3, the case in which four indoor units 2 are connected to the second relay unit 3*b* is shown as an example, and these units are illustrated as an indoor unit 2*a*, an indoor unit 2*b*, an indoor unit 2*c*, and an indoor unit 2*d* from the lower side of the figure. Also, in accordance with the indoor units 2*a* to 2*d*, the use side heat exchanger 26 is illustrated as a use side heat exchanger 26*a*, a use side heat exchanger 26*b*, a use side heat exchanger 26*c*, and a use side heat exchanger 26*d* from the lower side of the figure. Similarly to FIG. 1, the number of connected indoor units 2 is not limited to four shown in FIG. 3.

(Relay Unit 3)

The relay unit 3 is constituted by the first relay unit 3*a* and the second relay unit 3*b* in separate housings. By using this configuration, a plurality of the second relay units 3*b* can be connected to the single first relay unit 3*a*, as described above. In the first relay unit 3*a*, a gas-liquid separator 14, an expansion valve 16*e*, a pressure sensor 39, and a pressure sensor 40 are disposed. In the second relay unit 3*b*, two intermediate heat exchangers 15, four expansion valves 16, two pumps 21, four channel switching valves 22, four channel switching valves 23, four stop valves 24, and four flow control valves 25 are disposed.

The gas-liquid separator 14 is connected to one refrigerant pipeline 4 connected to the heat-source device 1 and two refrigerant pipelines 4 that connect the first intermediate heat exchanger 15*a* and the second intermediate heat exchanger 15*b* of the second relay unit 3*b* and separates the heat-source-side refrigerant supplied from the heat-source device 1 into a steam refrigerant and a liquid refrigerant. The expansion valve 16*e* is disposed between the refrigerant pipeline 4 that connects the expansion valve 16*a* as well as the expansion valve 16*b* and the gas-liquid separator 14 and functions as a decompressing valve or a throttle device so as to decompresses and expands the heat-source-side refrigerant. The expansion valve 16*e* is preferably constituted by a device capable of variably controlling an opening degree such as an electronic expansion valve, for example. The pressure sensor 39 is disposed in a refrigerant pipeline that connects the refrigerant pipeline 4 and the gas-liquid separator 14 and detects a pressure of the heat-source-side refrigerant flowing (supplied) from the heat-source device 1 into the first relay unit (or in more detail, the gas-liquid separator 14). The pressure sensor 40 is disposed in a refrigerant pipeline that connects the expansion valve 16*b* and the expansion valve 16*c* to the refrigerant pipeline 4 and detects a pressure of the heat-source-side refrigerant flowing out of the second relay unit 3*b* (and flowing into the heat-source device 1).

The two intermediate heat exchangers 15 (the first intermediate heat exchanger 15*a* and the second intermediate heat exchanger 15*b*) function as condensers or evaporators, exchange heat between the heat-source-side refrigerant and the heat medium and supply cooling energy or heating energy generated in the heat-source device 1 to the indoor unit 2. In the flow of the heat-source-side refrigerant, the first intermediate heat exchanger 15*a* is disposed between the gas-liquid separator 14 and the expansion valve 16*d* and serves for heating of the heat medium. In the flow of the heat-source-side refrigerant, the second intermediate heat exchanger 15*b* is disposed between the expansion valve 16*a* and the expansion valve 16*c* and serves for cooling the heat medium.

The four expansion valves 16 (expansion valves 16*a* to 16*d*) function as decompressing valves or throttle devices and decompresses and expands the heat-source-side refrigerant. The expansion valve 16*a* is disposed between the expansion valve 16*e* and the second intermediate heat exchanger 15*b*. The expansion valve 16*b* is disposed to be parallel with the expansion valve 16*a*. The expansion valve 16*c* is disposed between the second intermediate heat exchanger 15*b* and the first relay unit 3*a*. The expansion valve 16*d* is disposed between the first intermediate heat exchanger 15*a* and the expansion valve 16*a* as well as the expansion valve 16*b*. The four expansion valves 16 are preferably constituted by devices capable of variably controlling opening degrees such as electronic expansion valves, for example.

The two pumps 21 (a first pump 21*a* and a second pump 21*b*) circulate the heat medium flowing through the pipeline 5. The first pump 21*a* is disposed in the pipeline 5 between the first intermediate heat exchanger 15*a* and the channel switching valve 22. The second pump 21*b* is disposed in the pipeline 5 between the second intermediate heat exchanger 15*b* and the channel switching valve 22. The first pump 21*a* and the second pump 21*b* are not particularly limited to a certain type and are preferably pumps capable of capacity control, for example.

The four channel switching valves 22 (channel switching valves 22*a* to 22*d*) are constituted by three-way valves and switch the channels of the heat medium. The channel switching valves 22 are provided in a number (four, here) corresponding to the number of the installed indoor units 2. The channel switching valves 22 are provided on the inlet sides of heat medium channels of the use side heat exchangers 26 with one of the three ways connected to the first intermediate heat exchanger 15*a*, one of the three ways to the second intermediate heat exchanger 15*b*, and one of the three ways to the stop valve 24, respectively. The channel switching valve 22*a*, the channel switching valve 22*b*, the channel switching valve 22*c*, and the channel switching valve 22*d* are shown corresponding to the indoor units 2 from the lower side in the figure.

The four channel switching valves 23 (channel switching valves 23*a* to 23*d*) are constituted by three-way valves and switch the channels of the heat medium. The channel switching valves 23 are provided in a number (four, here) corresponding to the number of the installed indoor units 2. The channel switching valves 23 are provided on outlet sides of heat medium channels of the use side heat exchangers 26 with one of the three ways connected to the first intermediate heat exchanger 15*a*, one of the three ways to the second intermediate heat exchanger 15*b*, and one of the three ways to the flow control valve 25, respectively. The channel switching valve 23*a*, the channel switching valve 23*b*, the channel switching valve 23*c*, and the channel switching valve 23*d* are shown corresponding to the indoor units 2 from the lower side in the figure.

The four stop valves 24 (stop valves 24*a* to 24*d*) are constituted by two-way valves and open/close the pipeline 5. The stop valves 24 are provided in a number (four, here) corresponding to the number of the installed indoor units 2. The stop valves 24 have one end connected to the use side heat exchangers 26 and the other to the channel switching valves 22, respectively, and are disposed on the inlet sides of the heat medium channels of the use side heat exchangers 26. The stop valve 24*a*, the stop valve 24*b*, the stop valve 24*c*, and the stop valve 24*d* are shown corresponding to the indoor units 2 from the lower side of the figure.

The four flow control valves 25 (flow control valves 25*a* to 25*d*) are constituted by three-way valves and switch the channels of the heat medium. The flow control valves 25 are provided in a number (four, here) corresponding to the number of the installed indoor units 2. The flow control valves 25 are provided on the outlet sides of the heat medium channels of the use side heat exchangers 26 with one of the three ways connected to the use side heat exchanger 26, one of the three ways to a bypass 27, and one of the three ways to the channel switching valve 23, respectively. The flow control valve 25*a*, the flow control valve 25*b*, the flow control valve 25*c*, and the flow control valve 25*d* are shown from the lower side of the figure corresponding to the indoor units 2.

The bypasses 27 are provided so as to connect the pipeline 5 between the stop valves 24 and the use side heat exchangers 26 to the flow control valves 25. The bypasses 27 are disposed in a number (four, here, that is, a bypass 27*a*, a bypass 27*b*, a bypass 27*c*, and a bypass 27*d*) corresponding to the number of the installed indoor units 2. The bypass 27*a*, the bypass 27*b*, the bypass 27*c*, and the bypass 27*d* are shown from the lower side of the figure corresponding to the indoor units 2.

Also, in the second relay unit 3*b*, two first temperature sensors 31, two second temperature sensors 32, four third temperature sensors 33, four fourth temperature sensors 34, a fifth temperature sensor 35, a pressure sensor 36, a sixth temperature sensor 37, and a seventh temperature sensor 38 are disposed.

The two first temperature sensors 31 (first temperature sensor 31*a* and first temperature sensor 31*b*) detect the temperature of the heat medium flowing out of the intermediate heat exchanger 15, that is, the heat medium at the outlet of the intermediate heat exchanger 15 and are preferably constituted by thermistors, for example. The first temperature sensor 31*a* is disposed on the pipeline 5 on the inlet side of the first pump 21*a*. The first temperature sensor 31*b* is disposed on the pipeline 5 on the inlet side of the second pump 21*b*.

The two second temperature sensors 32 (second temperature sensor 32*a* and second temperature sensor 32*b*) detect the temperature of the heat medium flowing into the intermediate heat exchanger 15, that is, the heat medium at the inlet of the intermediate heat exchanger 15 and are preferably constituted by thermistors, for example. The second temperature sensor 32*a* is disposed on the pipeline 5 on the inlet side of the first intermediate heat exchanger 15*a*. The second temperature sensor 32*b* is disposed on the pipeline 5 on the inlet side of the second intermediate heat exchanger 15*b*.

The four third temperature sensors 33 (third temperature sensors 33*a* to 33*d*) are disposed on the inlet sides of the heat medium channels of the use side heat exchangers 26 so as to detect the temperature of the heat medium flowing into the use side heat exchangers 26 and are preferably constituted by thermistors, for example. The third temperature sensors 33 are provided in a number (four, here) corresponding to the number of the installed indoor units 2. The third temperature sensor 33*a*, the third temperature sensor 33*b*, the third temperature sensor 33*c*, and the third temperature sensor 33*d* are shown from the lower side in the figure corresponding to the indoor units 2.

The four fourth temperature sensors 34 (fourth temperature sensors 34*a* to 34*d*) are disposed on the outlet sides of the heat medium channels of the use side heat exchangers 26 and detect the temperature of the heat medium flowing out of the use side heat exchanger 26 and are preferably constituted by thermistors, for example. The fourth temperature sensors 34 are provided in a number (four, here) corresponding to the number of the installed indoor units 2. The fourth temperature sensor 34*a*, the fourth temperature sensor 34*b*, the fourth temperature sensor 34*c*, and the fourth temperature sensor 34*d* are shown from the lower side in the figure corresponding to the indoor units 2.

The fifth temperature sensor 35 is disposed on the outlet side of the heat-source-side refrigerant channel of the first intermediate heat exchanger 15*a* and detects the temperature of the heat-source-side refrigerant flowing out of the first intermediate heat exchanger 15*a* and is preferably constituted by a thermistor, for example. The pressure sensor 36 is disposed on the outlet side of the heat-source-side refrigerant channel of the first intermediate heat exchanger 15*a* and detects the pressure of the heat-source-side refrigerant flowing out of the first intermediate heat exchanger 15*a* and is preferably constituted by a pressure sensor or the like.

The sixth temperature sensor 37 is disposed on the inlet side of the heat-source-side refrigerant channel of the second intermediate heat exchanger 15*b* and detects the temperature of the heat-source-side refrigerant flowing into the second intermediate heat exchanger 15*b* and is preferably constituted by a thermistor, for example. The seventh temperature sensor 38 is disposed on the outlet side of the heat-source-side refrigerant channel of the second intermediate heat exchanger 15*b* and detects the temperature of the heat-source-side refrigerant flowing out of the second intermediate heat exchanger 15*b* and is preferably constituted by a thermistor, for example.

The pipeline 5 through which the heat medium is guided is constituted by the one connected to the first intermediate heat exchanger 15*a* (hereinafter referred to as a pipeline 5*a*) and the other connected to the second intermediate heat exchanger 15*b* (hereinafter referred to as a pipeline 5*b*). The pipeline 5*a* and the pipeline 5*b* branch into branch lines in a number (four, here) corresponding to the number of indoor units 2 connected to the relay unit 3. Then, the pipeline 5*a* and the pipeline 5*b* are connected by the channel switching valve 22, the channel switching valve 23, and the flow control valve 25. By controlling the channel switching valve 22 and the channel switching valve 23, whether to supply the heat medium guided through the pipeline 5*a* into the use side heat exchanger 26 or to supply the heat medium guided through the pipeline 5*b* into the use side heat exchanger 26 is determined.

(Controller)

Also, in each unit (the heat-source device 1, the first relay unit 3*a*, the second relay unit 3*b*, and the indoor unit 2), a controller that controls an operation of each unit is disposed. Each of these controllers is constituted by a microcomputer and the like, for example. A controller 61 is disposed in the heat-source device 1 and controls an operation of each device disposed in the heat-source device 1 such as a running frequency of the compressor 10, switching of the four-way valve 11 and the like. Also, the controller 61 is connected to the pressure sensor 39 and the pressure sensor 40, too, and is capable of grasping detected pressures of the pressure sensor 39 and the pressure sensor 40. A controller 63*a* is disposed in the first relay unit 3*a* and controls an operation of each device disposed in the first relay unit 3*a* such as an opening degree of the expansion valve 16*e*, for example. A controller 63*b* is disposed in the second relay unit 3*b* and controls an operation of each device disposed in the second relay unit 3*b* such as running of the pump 21, opening degrees of the expansion valves 16*a* to 16*d*, switching of the channel switching valve 22 and the channel switching valve 23, opening/closing of the stop valve 24, switching of the flow control valve 25 and the like. A controller 62 is disposed in the indoor unit 2 and controls an operation of each device disposed in the indoor unit 2 such as a rotation number (including ON/OFF) of a fan installed close to the use side heat exchanger 26 and the like. Also, the controller 62 is connected to the third temperature sensor 33 and is capable of grasping the temperature detected by the third temperature sensor 33. The controller 62 can be disposed in the number corresponding to the number of the installed indoor units 2 (four here). A controller 62*a*, a controller 62*b*, a controller 62*c*, and a controller 62*d* are illustrated from the lower side in the figure in accordance with the indoor units 2.

Here, the controller 61, the controller 63*a*, and the controller 63*b* correspond to a first controller of the present invention. The controller 62 corresponds to a second controller of the present invention. The controller 61 corresponds to a third controller of the present invention. The controller 63*a* and the controller 63*b* correspond to a fourth controller of the present invention. The controller 63*a* corresponds to a fifth controller of the present invention. The controller 63*b* corresponds to a sixth controller of the present invention.

Each of the controller 62, the controller 63*b*, the controller 63*a*, and the controller 61 independently controls each unit in which each of them is disposed. Also, the controller 62, the controller 63*b*, the controller 63*a*, and the controller 61 are sequentially connected by a communication line. Thus, each unit of the air-conditioning apparatus 100 starts operation in the following order. If an operation instruction is inputted into the controller 62 of the indoor unit 2 on the basis of information from the remote controller, for example, the controller 62 starts the operation of the indoor unit. Then, the controller 62 inputs an operation instruction to the controller 63*b*. The controller 63*b* to which the operation instruction was inputted from the controller 62 starts an operation of the second relay unit 3*b* and inputs an operation instruction to the controller 63*a*. The controller 63*a* to which the operation instruction is inputted from the controller 63*b* starts an operation of the first relay unit 3*a* and inputs an operation instruction to the controller 61. The controller 61 to which the operation instruction is inputted from the first relay unit 3*a* starts an operation of the heat-source device 1.

The controller 62, the controller 63*b*, the controller 63*a*, and the controller 61 are capable of transmitting/receiving an operation state of each unit via the communication line. At this time, the operation state of a unit which has stopped by occurrence of an abnormality is handled as usual stoppage.

In this air-conditioning apparatus 100, the compressor 10, the four-way valve 11, the heat-source-side heat exchanger 12, the refrigerant channel of the first intermediate heat exchanger 15*a*, the refrigerant channel of the second intermediate heat exchanger 15*b*, and the accumulator 17 are connected by the refrigerant pipeline 4 through which the refrigerant flows so as to constitute a refrigeration cycle. Also, the heat medium channel of the first intermediate heat exchanger 16*a*, the first pump 21*a*, and the use side heat exchanger 26 are connected in order by the pipeline 5*a* through which the heat medium flows so as to constitute a heat-medium circulation circuit. Similarly, the heat-medium channel of the second intermediate heat exchanger 15*b*, the second pump 21*b*, and the use side heat exchanger 26 are connected in order in series by the pipeline 5*b* through which the heat medium flows so as to constitute a heat-medium circulation circuit. That is, a plurality of use side heat exchangers 26 are connected in parallel to each of the intermediate heat exchangers 15 so as to have plural systems of the heat-medium circulation circuits.

That is, in the air-conditioning apparatus 100, the heat-source device 1 and the relay unit 3 are connected via the first intermediate heat exchanger 15*a* and the second intermediate heat exchanger 15*b* disposed in the relay unit 3, and the relay unit 3 and the indoor units 2 are connected by the first intermediate heat exchanger 15*a* and the second intermediate heat exchanger 15*b*. And the first intermediate heat exchanger 15*a* and the second intermediate heat exchanger 15*b* exchange heat between the heat-source-side refrigerant, which is a primary-side refrigerant circulating through the refrigeration cycle, and the heat medium, which is a secondary-side refrigerant circulating through the heat-medium circulation circuit.

Here, the type of the refrigerant used in the refrigeration cycle and the heat-medium circulation circuit will be described. In the refrigeration cycle, a zeotropic refrigerant mixture such as R407C and the like, a near-azeotropic refrigerant mixture such as R410A, R404A and the like, a single refrigerant such as R22, R134a and the like can be used. Also, natural refrigerants including carbon dioxide, hydrocarbon and the like can be used. By using a natural refrigerant as the heat-source-side refrigerant, an advantage of suppressing a greenhouse effect of the earth caused by refrigerant leakage can be obtained. Particularly, since carbon dioxide exchanges heat without being condensed on the high-pressure side in a supercritical state, by setting the heat-source-side refrigerant and the heat medium in a countercurrent format in the first intermediate heat exchanger 15*a* and the second intermediate heat exchanger 15*b* as shown in FIG. 2, heat exchange performance when the heat medium is heated or cooled can be improved.

The heat-medium circulation circuit is connected to the use side heat exchanger 26 of the indoor unit 2 as described above. Thus, in the air-conditioning apparatus 100, use of a heat medium with high safety is assumed in consideration of leakage of the heat medium into a room where the indoor unit 2 is installed or the like. Therefore, as the heat medium, water, an anti-freezing fluid, a mixed solution of water and an anti-freezing fluid or the like, for example, can be used. According to this configuration, even if the refrigerant leaks from the pipeline, inflow of the leaking refrigerant into the room can be suppressed, whereby high reliability can be obtained. Also, if the indoor unit 2 is installed in a place where moisture should be avoided such as a computer room, a fluorine inactive liquid with high thermal insulation can be also used as the heat medium.

<Operation Mode of Air-Conditioning Apparatus 100>

Subsequently, each operation mode executed by the air-conditioning apparatus 100 will be described.

The air-conditioning apparatus 100 is capable of a cooling operation or a heating operation with the indoor units 2 thereof on the basis of an instruction from each indoor unit 2. More specifically, the air-conditioning apparatus 100 is capable of the same operation by all the indoor units 2 and of different operations by each of the indoor units 2. That is, the air-conditioning apparatus 100 according to this embodiment is an air-conditioning apparatus capable of the simultaneous operation of cooling and heating. Four operation modes performed by the air-conditioning apparatus 100, that is, a cooling-only operation mode in which all the running indoor units 2 perform the cooling operation, a heating-only operation mode in which all the running indoor units 2 perform the heating operation, a cooling-main operation mode in which a cooling load is larger, and a heating-main operation mode in which a heating load is larger will be described below with a flow of the refrigerant.

(Cooling-Only Operation Mode)

Figure 4:
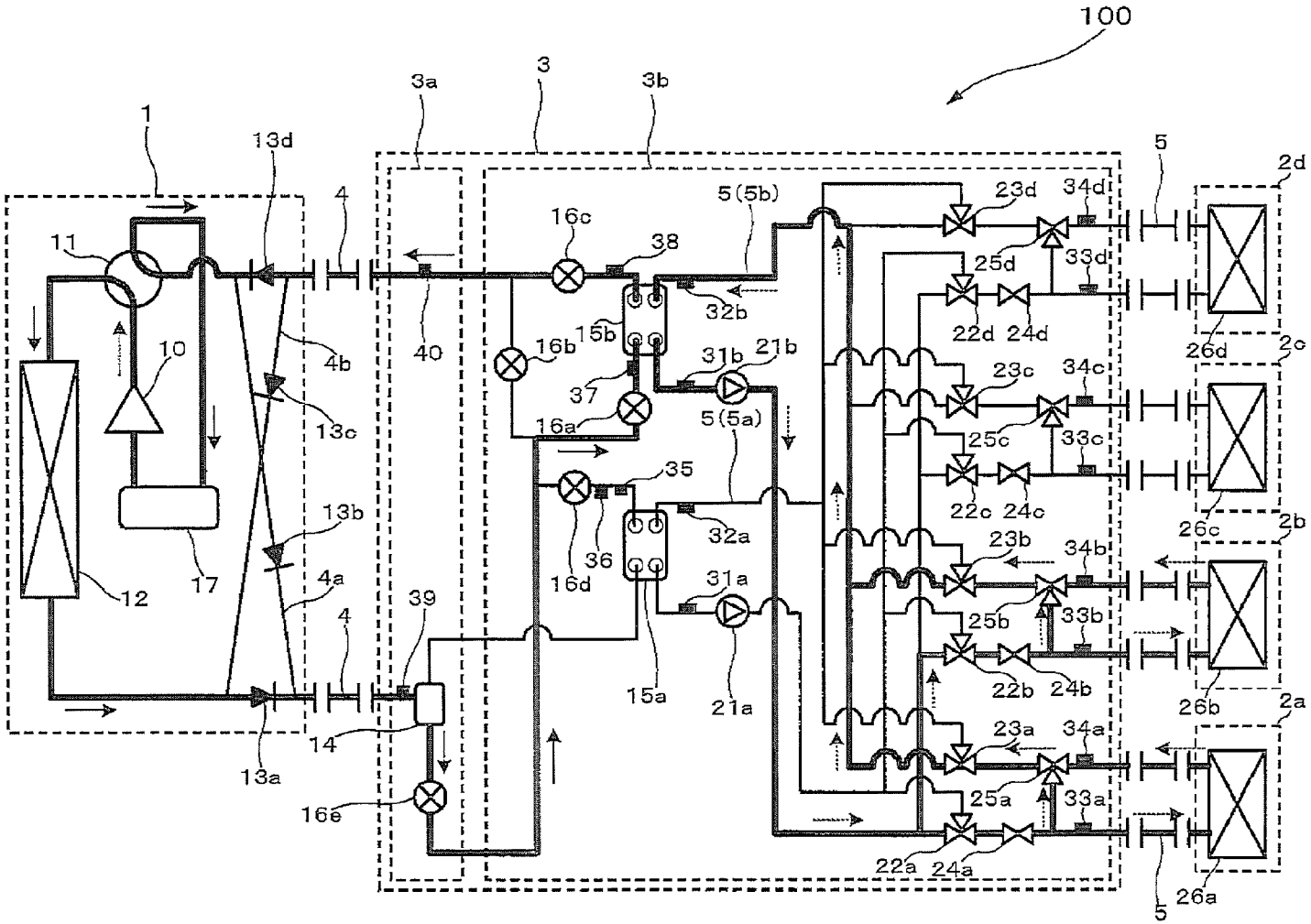
FIG. 4 is a refrigerant cycle diagram illustrating a flow of the refrigerant in a cooling-only operation mode of the air-conditioning apparatus.

FIG. 4 is a refrigerant cycle diagram illustrating a flow of a refrigerant in the cooling-only operation mode of the air-conditioning apparatus 100. In FIG. 4, the cooling-only operation mode will be described using an example in which a cooling load is generated only in the use side heat exchanger 26*a* and the use side heat exchanger 26*b*. That is, in FIG. 4, the case in which the cooling load is not generated in the use side heat exchanger 26*c* and the use side heat exchanger 26*d* is illustrated. In FIG. 4, a pipeline expressed by a bold line indicates a pipeline through which the refrigerant (the heat-source-side refrigerant and the heat medium) circulates. Also, a flow direction of the heat-source-side refrigerant is indicated by a solid-line arrow, while the flow direction of the heat medium by a broken-line arrow.

In the case of the cooling-only operation mode shown in FIG. 4, in the heat-source device 1, the four-way valve 11 is switched so that the heat-source-side refrigerant discharged from the compressor 10 flows into the heat-source-side heat exchanger 12. In the relay unit 3, the first pump 21*a* is stopped, the second pump 21*b* is run, and the stop valve 24*a* and the stop valve 24*b* are opened, while the stop valve 24*c* and the stop valve 24*d* are closed so that the heat medium circulates between the second intermediate heat exchanger 15*b* and each of the use side heat exchangers 26 (use side heat exchanger 26*a* and the use side heat exchanger 26*b*). In this state, the operation of the compressor 10 is started.

First, the flow of the heat-source-side refrigerant in the refrigeration cycle will be described.

A low-temperature low-pressure refrigerant is compressed by the compressor 10, becomes a high-temperature high-pressure gas refrigerant and is discharged. The high-temperature high-pressure gas refrigerant discharged from the compressor 10 passes through the four-way valve 11 and flows into the heat-source-side heat exchanger 12. Then, the refrigerant is condensed and liquefied while transferring heat to the outdoor air in the heat-source-side heat exchanger 12 and becomes a high-pressure liquid refrigerant. The high-pressure liquid refrigerant having flowed out of the heat-source-side heat exchanger 12 passes through the check valve 13*a* and flows out of the heat-source device 1 and flows into (is supplied to) the first relay unit 3*a* via the refrigerant pipeline 4. The high-pressure liquid refrigerant having flowed into the first relay unit 3*a* flows into the gas-liquid separator 14 and then, passes through the expansion valve 16*e* and flows into (is supplied to) the second relay unit 3*b*.

The refrigerant having flowed into the second relay unit 3*b* is throttled by the expansion valve 16*a* and expanded and becomes a low-temperature low-pressure gas-liquid two-phase refrigerant. This gas-liquid two-phase refrigerant flows into the second intermediate heat exchanger 15*b* working as an evaporator, and while taking heat away from the heat medium circulating in the heat-medium circulation circuit so as to cool the heat medium, the refrigerant becomes the low-temperature low-pressure gas refrigerant. The gas refrigerant having flowed out of the second intermediate heat exchanger 15*b* passes through the expansion valve 16*c*, flows out of the second relay unit 3*b* and the first relay unit 3*a* and flows into the heat-source device 1 via the refrigerant pipeline 4. The refrigerant having flowed into the heat-source device 1 passes through the check valve 13*d* and is sucked into the compressor 10 again via the four-way valve 11 and the accumulator 17. The expansion valve 16*b* and the expansion valve 16*d* have small opening degrees so that the refrigerant does not flow therethrough, while the expansion valve 16*c* is in the fully open state so that a pressure loss does not occur.

Subsequently, the flow of the heat medium in the heat-medium circulation circuit will be described.

In the cooling-only operation mode, since the first pump 21*a* is stopped, the heat medium circulates through the pipeline 5*b*. The heat medium having been cooled by the heat-source-side refrigerant in the second intermediate heat exchanger 15*b* is fluidized in the pipeline 5*b* by the second pump 21*b*. The heat medium having been pressurized and flowed out by the second pump 21*b* passes through the stop valve 24 (the stop valve 24*a* and the stop valve 24*b*) via the channel switching valve 22 (the channel switching valve 22*a* and the channel switching valve 22*b*) and flows into (is supplied to) the use side heat exchanger 26 (the use side heat exchanger 26*a* and the use side heat exchanger 26*b*). Then, the refrigerant takes heat away from the indoor air in the use side heat exchanger 26 and cools a region to be air-conditioned such as the inside of the room where the indoor unit 2 is installed.

After that, the heat medium having flowed out of the use side heat exchanger 26 flows into the flow control valve 25 (the flow control valve 25*a* and the flow control valve 25*b*). At this time, by means of the action of the flow control valve 25, the heat medium only in a flow rate required to cover an air-conditioning load required in the region to be air-conditioned such as the inside of the room flows into the use side heat exchanger 26, while the remaining heat medium flows so as to bypass the use side heat exchanger 26 via the bypass 27 (the bypass 27*a* and the bypass 27*b*).

The heat medium passing through the bypass 27 does not contribute to the heat exchange but merges with the heat medium having passed through the use side heat exchanger 26, passes through the channel switching valve 23 (the channel switching valve 23*a* and the channel switching valve 23*b*), flows into the second intermediate heat exchanger 15*b* and is sucked into the second pump 21*b* again. The air-conditioning load required in the region to be air-conditioned such as the inside of the room can be covered by means of control such that a temperature difference between the third temperature sensor 33 and the fourth temperature sensor 34 is kept at a target value.

At this time, since there is no need to make the heat medium flow into the use side heat exchanger 26 (including thermo off) which does not have a heat load, the channel is closed by the stop valve 24 so that the heat medium does not flow into the use side heat exchanger 26. In FIG. 4, since there is a heat load in the use side heat exchanger 26*a* and the use side heat exchanger 26*b*, the heat medium is made to flow, but there is no heat load in the use side heat exchanger 26*c* and the use side heat exchanger 26*d*, and the corresponding stop valve 24*c* and the stop valve 24*d* are in the closed state. In the case of occurrence of a cooling load from the use side heat exchanger 26*c* or the use side heat exchanger 26*d*, it is only necessary to open the stop valve 24*c* or the stop valve 24*d* so that the heat medium is circulated.

(Heating-Only Operation Mode)

Figure 5:
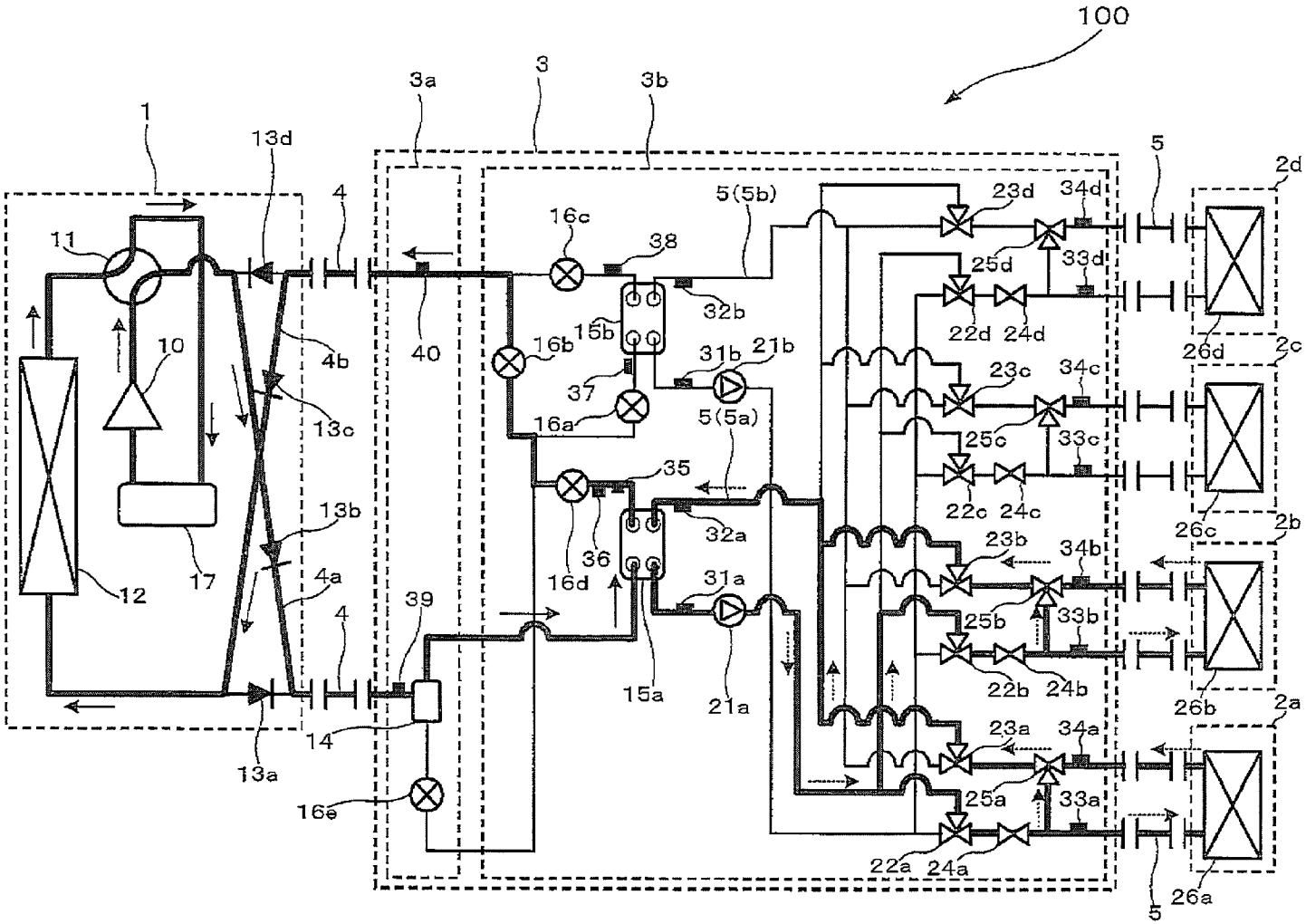
FIG. 5 is a refrigerant cycle diagram illustrating a flow of the refrigerant in a heating-only operation mode of the air-conditioning apparatus.

FIG. 5 is a refrigerant cycle diagram illustrating the flow of the refrigerant in the heating-only operation mode of the air-conditioning apparatus 100. In FIG. 5, the heating-only operation mode will be described using the case in which a heating load is generated only in the use side heat exchanger 26*a* and the use side heat exchanger 26*b* as an example. That is, in FIG. 5, the case in which the heating load is not generated in the use side heat exchanger 26*c* and the use side heat exchanger 26*d* is shown. In FIG. 5, the pipeline expressed by a bold line indicates a pipeline through which the refrigerant (heat-source-side refrigerant and the heat medium) circulates. Also, the flow direction of the heat-source-side refrigerant is indicated by a solid-line arrow, while the flow direction of the heat medium by a broken-line arrow.

In the case of the heating-only operation mode shown in FIG. 5, in the heat-source device 1, the four-way valve 11 is switched so that the heat-source-side refrigerant discharged from the compressor 10 flows into the relay unit 3 without going through the heat-source-side heat exchanger 12. In the relay unit 3, the switching is made so that the first pump 21*a* is run, the second pump 21*b* is stopped, the stop valve 24*a* and the stop valve 24*b* are opened, and the stop valve 24*c* and the stop valve 24*d* are closed so that the heat medium circulates between the first intermediate heat exchanger 15*a* and each use side heat exchanger 26 (the use side heat exchanger 26*a* and the use side heat exchanger 26*b*). In this state, the operation of the compressor 10 is started.

First, the flow of the heat-source-side refrigerant in the refrigeration cycle will be described.

A low-temperature low-pressure refrigerant is compressed by the compressor 10, becomes a high-temperature and high-pressure gas refrigerant and is discharged. The high-temperature high-pressure gas refrigerant discharged from the compressor 10 passes through the four-way valve 11, is guided through the first connection pipeline 4*a*, passes through the check valve 13*b* and flows out of the heat-source device 1. The high-temperature high-pressure gas refrigerant having flowed out of the heat-source device 1 flows into (is supplied to) the first relay unit 3*a* through the refrigerant pipeline 4. The high-temperature high-pressure gas refrigerant having flowed into the first relay unit 3*a* flows into the gas-liquid separator 14 and then, flows into the first intermediate heat exchanger 15*a* after passing through the expansion valve 16*e*. The high-temperature high-pressure gas refrigerant having flowed into the first intermediate heat exchanger 15*a* is condensed and liquefied while transferring heat to the heat medium circulating through the heat-medium circulation circuit and becomes a high-pressure liquid refrigerant.

The high-pressure liquid refrigerant having flowed out of the first intermediate heat exchanger 15*a* is throttled by the expansion valve 16*d* and expanded and brought into a low-temperature low-pressure gas-liquid two-phase state. The refrigerant in the gas-liquid two-phase state having been throttled by the expansion valve 16*d* passes through the expansion valve 16*b*, is guided through the refrigerant pipeline 4 and flows into the heat-source device 1 again. The refrigerant having flowed into the heat-source device 1 passes through the second connection pipeline 4*b* via the check valve 13*d* and flows into the heat-source-side heat exchanger 12 working as an evaporator. Then, the refrigerant having flowed into the heat-source-side heat exchanger 12 takes heat away from the outdoor air in the heat-source-side heat exchanger 12 so as to become a low-temperature low-pressure gas refrigerant. The low-temperature low-pressure gas refrigerant having flowed out of the heat-source-side heat exchanger 12 returns to the compressor 10 via the four-way valve 11 and the accumulator 17. The expansion valve 16*a*, the expansion valve 16*c*, and the expansion valve 16*e* have small opening degrees so that the refrigerant does not flow therethrough.

Subsequently, the flow of the heat medium in the heat-medium circulation circuit will be described.

In the heating-only operation mode, since the second pump 21*b* is stopped, the heat medium circulates through the pipeline 5*a*. The heat medium having been heated by the heat-source-side refrigerant in the first intermediate heat exchanger 15*a* is fluidized in the pipeline 5*a* by the first pump 21*a*. The heat medium having been pressurized by the first pump 21*a* and flowed out passes through the stop valve 24 (the stop valve 24*a* and the stop valve 24*b*) via the channel switching valve 22 (the channel switching valve 22*a* and the channel switching valve 22*b*) and flows into (is supplied to) the use side heat exchanger 26 (the use side heat exchanger 26*a* and the use side heat exchanger 26*b*). Then, the heat medium transfers heat to the indoor air in the use side heat exchanger 26 and heats the region to be air-conditioned such as the inside of the room where the indoor unit 2 is installed.

After that, the heat medium having flowed out of the use side heat exchanger 26 flows into the flow control valve 25 (the flow control valve 25*a* and the flow control valve 25*b*). At this time, by means of the action of the flow control valve 25, the heat medium only in a flow rate required to cover an air-conditioning load required in the region to be air-conditioned such as the inside of the room flows into the use side heat exchanger 26, while the remaining heat medium flows so as to bypass the use side heat exchanger 26 through the bypass 27 (the bypass 27*a* and the bypass 27*b*).

The heat medium passing through the bypass 27 does not contribute to the heat exchange but merges with the heat medium having passed through the use side heat exchanger 26, passes through the channel switching valve 23 (the channel switching valve 23*a* and the channel switching valve 23*b*), flows into the first intermediate heat exchanger 15*a* and is sucked into the first pump 21*a* again. The air-conditioning load required in the region to be air-conditioned such as the inside of the room can be covered by means of control such that a temperature difference between the third temperature sensor 33 and the fourth temperature sensor 34 is kept at a target value.

At this time, since there is no need to make the heat medium flow into the use side heat exchanger 26 (including thermo off) which does not have a heat load, the channel is closed by the stop valve 24 so that the heat medium does not flow into the use side heat exchanger 26. In FIG. 5, since there is a heat load in the use side heat exchanger 26*a* and the use side heat exchanger 26*b*, the heat medium is made to flow, but there is no heat load in the use side heat exchanger 26*c* and the use side heat exchanger 26*d*, and the corresponding stop valve 24*c* and the stop valve 24*d* are in the closed state. In the case of occurrence of a heating load from the use side heat exchanger 26*c* or the use side heat exchanger 26*d*, it is only necessary to open the stop valve 24*c* or the stop valve 24*d* so that the heat medium is circulated.

(Cooling-Main Operation Mode)

Figure 6:
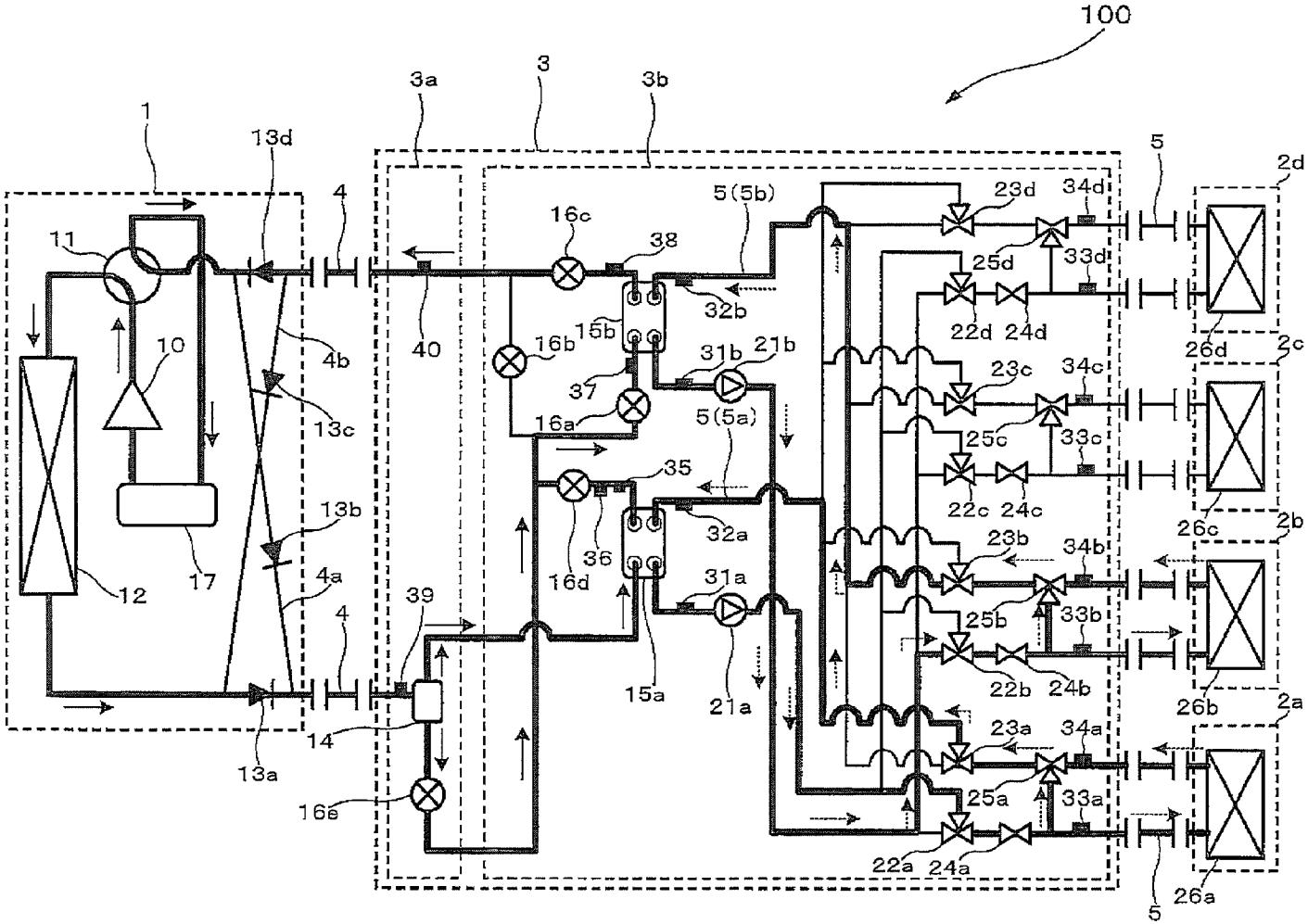
FIG. 6 is a refrigerant cycle diagram illustrating a flow of the refrigerant in a cooling-main operation mode of the air-conditioning apparatus.

FIG. 6 is a refrigerant cycle diagram illustrating the flow of the refrigerant during the cooling-main operation mode of the air-conditioning apparatus 100. In FIG. 6, using an example in which a heating load is generated in the use side heat exchanger 26*a* and a cooling load is generated in the use side heat exchanger 26*b*, the cooling-main operation mode will be described. That is, in FIG. 6, the example in which neither of the heating load nor the cooling load is generated in the use side heat exchanger 26*c* and the use side heat exchanger 26*d* is shown. In FIG. 6, the pipeline expressed by a bold line indicates a pipeline through which the refrigerant (heat-source-side refrigerant and the heat medium) circulates. Also, the flow direction of the heat-source-side refrigerant is indicated by a solid-line arrow, while the flow direction of the heat medium by a broken-line arrow.

In the case of the cooling-main operation mode shown in FIG. 6, in the heat-source device 1, the four-way valve 11 is switched so that the heat-source-side refrigerant discharged from the compressor 10 flows into the heat-source-side heat exchanger 12. In the relay unit 3, the first pump 21*a* and the second pump 21*b* are run, the stop valve 24*a* and the stop valve 24*b* are opened, the stop valve 24*c* and the stop valve 24*d* are closed, and the heat medium is made to circulate between the first intermediate heat exchanger 15*a* and the use side heat exchanger 26*a* as well as between the second intermediate heat exchanger 15*b* and the use side heat exchanger 26*b*. In this state, the operation of the compressor 10 is started.

First, the flow of the heat-source-side refrigerant in the refrigeration cycle will be described.

The low-temperature low-pressure refrigerant is compressed by the compressor 10 and discharged as the high-temperature high-pressure gas refrigerant. The high-temperature high-pressure gas refrigerant discharged from the compressor 10 passes through the four-way valve 11 and flows into the heat-source-side heat exchanger 12. Then, the refrigerant is condensed while transferring heat to the outdoor air in the heat-source-side heat exchanger 12 and becomes a gas-liquid two-phase refrigerant. The gas-liquid two-phase refrigerant having flowed out of the heat-source-side heat exchanger 12 flows out of the heat-source device 1 via the check valve 13*a* and flows into (is supplied to) the first relay unit 3*a* via the refrigerant pipeline 4. The gas-liquid two-phase refrigerant having flowed into the first relay unit 3*a* flows into the gas-liquid separator 14 and is separated into a gas refrigerant and a liquid refrigerant, which flow into (are supplied to) the second relay unit 3*b*.

The gas refrigerant having been separated in the gas-liquid separator 14 flows into the first intermediate heat exchanger 15*a*. The gas refrigerant having flowed into the first intermediate heat exchanger 15*a* is condensed and liquefied while transferring heat to the heat medium circulating through the heat-medium circulation circuit and turns into a liquid refrigerant. The liquid refrigerant having flowed out of the second intermediate heat exchanger 15*b* passes through the expansion valve 16*d*. On the other hand, the liquid refrigerant separated in the gas-liquid separator 14 passes through the expansion valve 16*e*, is condensed and liquefied in the first intermediate heat exchanger 15*a* and merges with the liquid refrigerant having passed through the expansion valve 16*d*, is throttled by the expansion valve 16*a* and expanded and flows into the second intermediate heat exchanger 15*b* as the low-temperature low-pressure gas-liquid two-phase refrigerant.

This gas-liquid two-phase refrigerant takes heat away from the heat medium circulating through the heat-medium circulation circuit in the second intermediate heat exchanger 15*b* working as an evaporator so as to cool the heat medium and becomes a low-temperature low-pressure gas refrigerant. The gas refrigerant having flowed out of the second intermediate heat exchanger 15*b* passes through the expansion valve 16*c* and then, flows out of the second relay unit 3*b* and the first relay unit 3*a* and flows into the heat-source device 1 via the refrigerant pipeline 4. The refrigerant having flowed into the heat-source device 1 passes through the check valve 13*d* and is sucked into the compressor 10 again via the four-way valve 11 and the accumulator 17. The expansion valve 16*b* has a small opening degree so that the refrigerant does not flow therethrough, and the expansion valve 16*c* is in the full open state so that a pressure loss does not occur.

Subsequently, the flow of the heat medium in the heat-medium circulation circuit will be described.

In the cooling-main operation mode, since the first pump 21*a* and the second pump 21*b* are both run, the heat medium is circulated through both the pipeline 5*a* and the pipeline 5*b*. The heat medium heated by the heat-source-side refrigerant in the first intermediate heat exchanger 15*a* is fluidized in the pipeline 5*a* by the first pump 21*a*. Also, the heat medium cooled by the heat-source-side refrigerant in the second intermediate heat exchanger 15*b* is fluidized in the pipeline 5*b* by the second pump 21*b*.

The heat medium having been pressurized by the first pump 21*a* and flowed out passes through the stop valve 24*a* via the channel switching valve 22*a* and flows into (is supplied to) the use side heat exchanger 26*a*. Then, in the use side heat exchanger 26*a*, the heat medium transfers heat to the indoor air and heats the region to be air-conditioned such as the inside of the room where the indoor unit 2 is installed. Also, the heat medium having been pressurized by the second pump 21*b* and flowed out passes through the stop valve 24*b* via the channel switching valve 22*b* and flows into (is supplied to) the use side heat exchanger 26*b*. Then, in the use side heat exchanger 26*b*, the heat medium takes heat away from the indoor air and cools the region to be air-conditioned such as the inside of the room where the indoor unit 2 is installed.

The heat medium having performed heating flows into the flow control valve 25*a*. At this time, by means of the action of the flow control valve 25*a*, the heat medium only in a flow rate required to cover an air-conditioning load required in the region to be air-conditioned flows into the use side heat exchanger 26*a*, while the remaining heat medium flows so as to bypass the use side heat exchanger 26*a* via the bypass 27*a*. The heat medium passing through the bypass 27*a* does not contribute to heat exchange but merges with the heat medium having passed through the use side heat exchanger 26*a*, flows into the first intermediate heat exchanger 15*a* through the channel switching valve 23*a* and is sucked into the first pump 21*a* again.

Similarly, the heat medium having performed cooling flows into the flow control valve 25*b*. At this time, by means of the action of the flow control valve 25*b*, the heat medium only in a flow rate required to cover an air-conditioning load required in the region to be air-conditioned flows into the use side heat exchanger 26*b*, while the remaining heat medium flows so as to bypass the use side heat exchanger 26*b* via the bypass 27*b*. The heat medium passing through the bypass 27*b* does not contribute to heat exchange but merges with the heat medium having passed through the use side heat exchanger 26*b*, flows into the second intermediate heat exchanger 15*b* via the channel switching valve 23*b* and is sucked into the second pump 21*b* again.

During that period, the heating energy medium (the heat medium used for the heating load) and the cooling energy medium (the heat medium used for the cooling load) flow into the use side heat exchanger 26*a* which has the heating load or the use side heat exchanger 26*b* which has the cooling load without mixing by means of the actions of the channel switching valves 22 (the channel switching valve 22*a* and the channel switching valve 22*b*) and the channel switching valves 23 (the channel switching valve 23*a* and the channel switching valve 23*b*). The air-conditioning load required in the region to be air-conditioned such as the inside of the room can be covered by executing control such that a difference in temperatures between the third temperature sensor 33 and the fourth temperature sensor 34 is kept at a target value.

At this time, since there is no need to make the heat medium flow into the use side heat exchanger 26 (including thermo off) which does not have a heat load, the channel is closed by the stop valve 24 so that the heat medium does not flow into the use side heat exchanger 26. In FIG. 6, since there is a heat load in the use side heat exchanger 26*a* and the use side heat exchanger 26*b*, the heat medium is made to flow, but there is no heat load in the use side heat exchanger 26*c* and the use side heat exchanger 26*d*, and the corresponding stop valve 24*c* and the stop valve 24*d* are in the closed state. In the case of occurrence of a heating load or occurrence of a cooling load from the use side heat exchanger 26*c* or the use side heat exchanger 26*d*, it is only necessary to open the stop valve 24*c* or the stop valve 24*d* so that the heat medium is circulated.

(Heating-Main Operation Mode)

Figure 7:
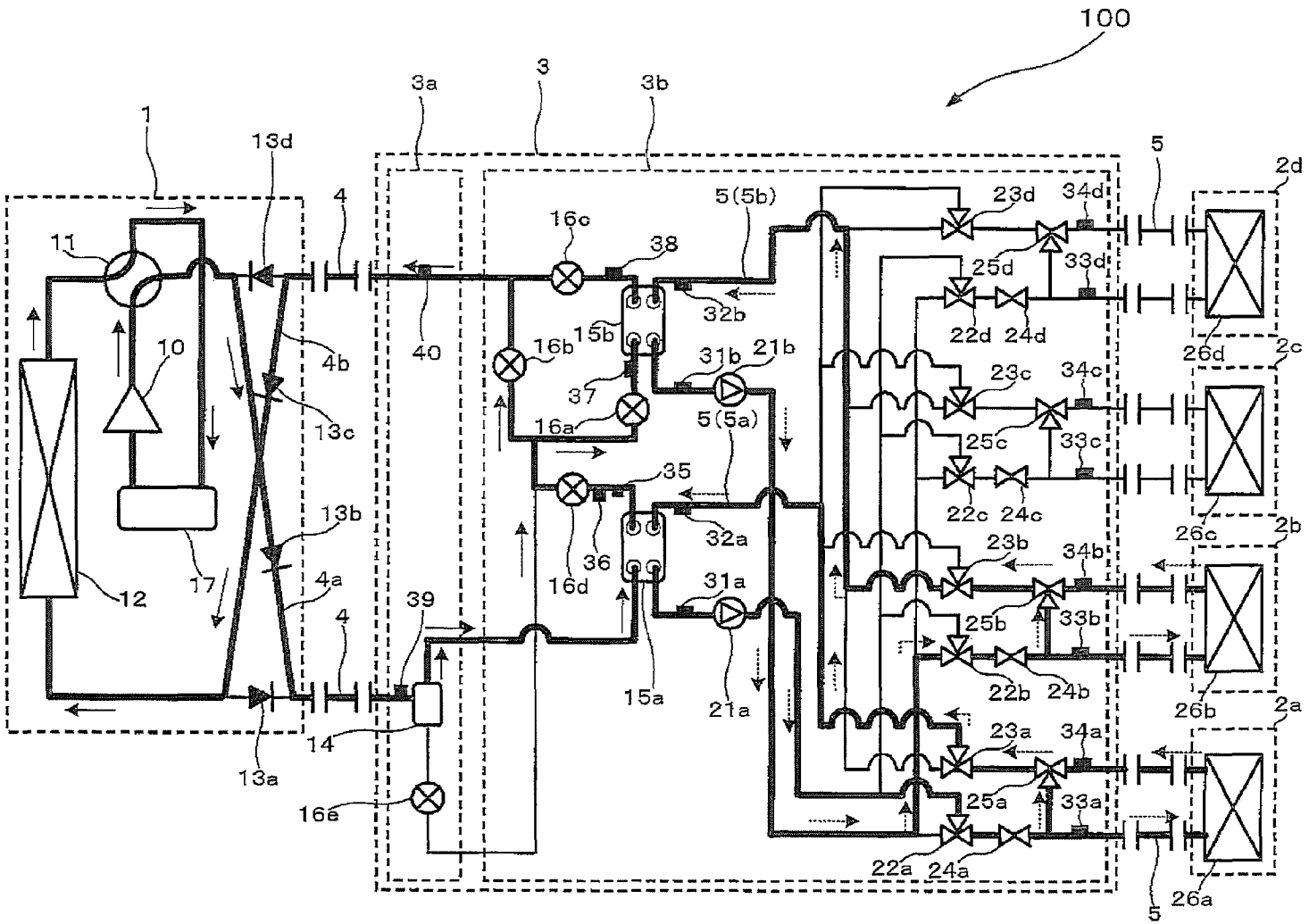
FIG. 7 is a refrigerant cycle diagram illustrating a flow of the refrigerant in a heating-main operation mode of the air-conditioning apparatus.

FIG. 7 is a refrigerant cycle diagram illustrating the flow of the refrigerant during the heating-main operation mode of the air-conditioning apparatus 100. In FIG. 7, using an example in which a heating load is generated in the use side heat exchanger 26*a* and a cooling load is generated in the use side heat exchanger 26*b*, the heating-main operation mode will be described. That is, in FIG. 7, the example in which neither of the heating load nor the cooling load is generated in the use side heat exchanger 26*c* and the use side heat exchanger 26*d* is shown. In FIG. 7, the pipeline expressed by a bold line indicates a pipeline through which the refrigerant (heat-source-side refrigerant and the heat medium) circulates. Also, the flow direction of the heat-source-side refrigerant is indicated by a solid-line arrow, while the flow direction of the heat medium by a broken-line arrow.

In the case of the heating-main operation mode shown in FIG. 7, in the heat-source device 1, the four-way valve 11 is switched so that the heat-source-side refrigerant discharged from the compressor 10 flows into the relay unit 3 without passing through the heat-source-side heat exchanger 12. In the relay unit 3, the first pump 21*a* and the second pump 21*b* are run, the stop valve 24*a* and the stop valve 24*b* are opened, the stop valve 24*c* and the stop valve 24*d* are closed, and the heat medium is made to circulate between the first intermediate heat exchanger 15*a* and the use side heat exchanger 26*a* as well as between the second intermediate heat exchanger 15*b* and the use side heat exchanger 26*b*. In this state, the operation of the compressor 10 is started.

First, the flow of the heat-source-side refrigerant in the refrigeration cycle will be described.

The low-temperature low-pressure refrigerant is compressed by the compressor 10 and becomes a high-temperature high-pressure gas refrigerant and is discharged. The high-temperature high-pressure gas refrigerant discharged from the compressor 10 passes through the four-way valve 11, is guided through the first connection pipeline 4*a*, passes through the check valve 13*b* and flows out of the heat-source device 1. The high-temperature high-pressure gas refrigerant having flowed out of the heat-source device 1 flows into (is supplied to) the first relay unit 3*a* via the refrigerant pipeline 4. The high-temperature high-pressure gas refrigerant having flowed into the first relay unit 3*a* flows into the gas-liquid separator 14 and then, flows into the first intermediate heat exchanger 15*a* after passing through the expansion valve 16*e*. The high-temperature high-pressure gas refrigerant having flowed into the first intermediate heat exchanger 15*a* is condensed and liquefied while transferring heat to the heat medium circulating through the heat-medium circulation circuit and becomes a high-pressure liquid refrigerant.

The high-pressure liquid refrigerant having flowed out of the first intermediate heat exchanger 15*a* is throttled by the expansion valve 16*d* and expanded and brought into a low-temperature low-pressure gas-liquid two-phase state. The refrigerant in the gas-liquid two-phase state having been throttled by the expansion valve 16*d* is divided into a channel through the expansion valve 16*a* and a channel through the expansion valve 16*b*. The refrigerant having passed through the expansion valve 16*a* is further expanded by this expansion valve 16*a* and turns into a low-temperature low-pressure gas-liquid two-phase refrigerant and flows into the second intermediate heat exchanger 15*b* working as an evaporator. The refrigerant having flowed into the second intermediate heat exchanger 15*b* takes heat away from the heat medium in the second intermediate heat exchanger 15*b* and turns into a low-temperature low-pressure gas refrigerant. The low-temperature low-pressure gas refrigerant having flowed out of the second intermediate heat exchanger 15*b* passes through the expansion valve 16*c*.

On the other hand, the refrigerant having been throttled by the expansion valve 16*d* and flowed to the expansion valve 16*b* merges with the refrigerant having passed through the second intermediate heat exchanger 15*b* and the expansion valve 16*c* and becomes a low-temperature low-pressure refrigerant with larger dryness. Then, the merged refrigerant flows out of the second relay unit 3*b* and the first relay unit 3*a* and flows into the heat-source device 1 through the refrigerant pipeline 4. The refrigerant having flowed into the heat-source device 1 passes through the second connection pipeline 4*b* via the check valve 13*c* and flows into the heat-source-side heat exchanger 12 working as an evaporator. Then, the refrigerant having flowed into the heat-source-side heat exchanger 12 takes heat away from the outdoor air in the heat-source-side heat exchanger 12 and becomes a low-temperature low-pressure gas refrigerant. The low-temperature low-pressure gas refrigerant having flowed out of the heat-source-side heat exchanger 12 returns to the compressor 10 through the four-way valve 11 and the accumulator 17. The expansion valve 16*e* has a small opening degree so that the refrigerant does not flow therethrough.

Subsequently, the flow of the heat medium in the heat-medium circulation circuit will be described.

In the heating-main operation mode, since the first pump 21*a* and the second pump 21*b* are both run, the heat medium is circulated through both the pipeline 5*a* and the pipeline 5*b*. The heat medium heated by the heat-source-side refrigerant in the first intermediate heat exchanger 15*a* is fluidized in the pipeline 5*a* by the first pump 21*a*. Also, the heat medium cooled by the heat-source-side refrigerant in the second intermediate heat exchanger 15*b* is fluidized in the pipeline 5*b* by the second pump 21*b*.

The heat medium having been pressurized by the first pump 21*a* and flowed out passes through the stop valve 24*a* via the channel switching valve 22*a* and flows into (is supplied to) the use side heat exchanger 26*a*. Then, in the use side heat exchanger 26*a*, the heat medium transfers heat to the indoor air and heats the region to be air-conditioned such as the inside of the room where the indoor unit 2 is installed. Also, the heat medium having been pressurized by the second pump 21*b* and flowed out passes through the stop valve 24*b* via the channel switching valve 22*b* and flows into (is supplied to) the use side heat exchanger 26*b*. Then, in the use side heat exchanger 26*b*, the heat medium takes heat away from the indoor air and cools the region to be air-conditioned such as the inside of the room where the indoor unit 2 is installed.

The heat medium having flowed out of the use side heat exchanger 26*a* flows into the flow control valve 25*a*. At this time, by means of the action of the flow control valve 25*a*, the heat medium only in a flow rate required to cover an air-conditioning load required in the region to be air-conditioned such as the inside of the room flows into the use side heat exchanger 26*a*, while the remaining heat medium flows so as to bypass the use side heat exchanger 26*a* through the bypass 27*a*. The heat medium passing through the bypass 27*a* does not contribute to heat exchange but merges with the heat medium having passed through the use side heat exchanger 26*a*, flows into the first intermediate heat exchanger 15*a* through the channel switching valve 23*a* and is sucked into the first pump 21*a* again.

Similarly, the heat medium having flowed out of the use side heat exchanger 26*b* flows into the flow control valve 25*b*. At this time, by means of the action of the flow control valve 25*b*, the heat medium only in a flow rate required to cover an air-conditioning load required in the region to be air-conditioned such as the inside of the room flaws into the use side heat exchanger 26*b*, while the remaining heat medium flows so as to bypass the use side heat exchanger 26*b* through the bypass 27*b*. The heat medium passing through the bypass 27*b* does not contribute to heat exchange but merges with the heat medium having passed through the use side heat exchanger 26*b*, flows into the second intermediate heat exchanger 15*b* through the channel switching valve 23*b* and is sucked into the second pump 21*b* again.

During that period, the heating energy medium and the cooling energy medium flow into the use side heat exchanger

26*a* which has the heating load or the use side heat exchanger 26*b* which has the cooling load without mixing by means of the actions of the channel switching valves 22 (the channel switching valve 22*a* and the channel switching valve 22*b*) and the channel switching valves 23 (the channel switching valve 23*a* and the channel switching valve 23*b*). The air-conditioning load required in the region to be air-conditioned such as the inside of the room can be covered by executing control such that a difference in temperatures between the third temperature sensor 33 and the fourth temperature sensor 34 is kept at a target value.

At this time, since there is no need to make the heat medium flow into the use side heat exchanger 26 (including thermo off) not having a heat load, the channel is closed by the stop valve 24 so that the heat medium does not flow into the use side heat exchanger 26. In FIG. 7, since there is a heat load in the use side heat exchanger 26*a* and the use side heat exchanger 26*b*, the heat medium is made to flow, but there is no heat load in the use side heat exchanger 26*c* and the use side heat exchanger 26*d*, and the corresponding stop valve 24*c* and the stop valve 24*d* are in the closed state. In the case of occurrence of a heating load or occurrence of a cooling load from the use side heat exchanger 26*c* or the use side heat exchanger 26*d*, it is only necessary to open the stop valve 24*c* or the stop valve 24*d* so that the heat medium is circulated.

<Operation of Each Unit at Detection of an Abnormality>

If an abnormality occurs in each unit of the heat-source device 1, the first relay unit 3*a*, the second relay unit 3*b*, and the indoor unit 2 constituting the air-conditioning apparatus 100, the controller that detected the abnormality stops the operation of the unit. Here, if an abnormality occurs in a unit other than the indoor unit, in the prior-art air-conditioning apparatus, the indoor units where an abnormality does not occur need to be stopped. However, if air conditioning (cooling or heating) is being performed in a server room or the like whose indoor temperature should be kept at a certain temperature or less, stopping of the indoor unit should be avoided as much as possible. Thus, the air-conditioning apparatus 100 according to this embodiment is operated so that even if an abnormality occurs in the unit other than the indoor unit 2, the stopping of the indoor units 2 where an abnormality does not occur is delayed as much as possible.

An abnormality which can occur in each unit includes an abnormality in each device disposed in the unit, a communication abnormality between the controllers and the like, for example. First, an operation of each unit if an abnormality is detected in each device disposed in the unit will be described. After that, the operation of each unit if a communication abnormality occurs between the controllers will be described.

In the following, using the air-conditioning apparatus 100 in which the relay unit 3 is divided into the first relay unit 3*a* and the second relay unit 3*b* as an example, the operation of each unit at detection of an abnormality will be described. In the case of the air-conditioning apparatus 100 in which the relay unit 3 is not divided into the first relay unit 3*a* and the second relay unit 3*b*, the operation of the second relay unit 3*b* below is the operation of the relay unit 3.

[If an Abnormality in Each Device Disposed in Unit is Detected]

(If the Controller 61 of the Heat-Source Device 1 Detects an Abnormality)

If the controller 61 detects an operation abnormality of the compressor 10, the four-way valve 11 and the like, an operation abnormality of a heat-source refrigerant (a pressure abnormality, a temperature abnormality or the like) in the refrigeration cycle device or the like, the controller stops the operation of the heat-source device 1.

The heat-source device 1 and the first relay unit 3*a* perform operations in conjunction with each other. Thus, the controller 63*a* having received stop information of the heat-source device 1 stops the operation of the first relay unit 3*a*.

The controller 61 and the controller 63*a* try resuming of operations of the heat-source device 1 and the first relay unit 3*a* after a predetermined time has elapsed. This resuming of operation trial is repeated a predetermined number of times. That is because the abnormality detected by the controller 61 might be a transient abnormality (noise, an abnormality which occurs in a transition state before a stable operation is established or the like). If the controller 61 still detects an abnormality even after the resuming of operation trial is repeated a predetermined number times, the controller 61 and the controller 63*a* stop the heat-source device 1 and the first relay unit 3*a* for the abnormality.

Even if the heat-source device 1 is stopped, a certain amount of heat capacity is reserved in the heat medium in the heat-medium circulation circuit. That is, in the air-conditioning apparatus having the refrigeration cycle and the heat-medium circulation circuit like the air-conditioning apparatus 100, even if the heat-source device 1 is stopped (even if the flow of the refrigerant in the refrigeration cycle is stopped), the temperature of the heat medium in the heat-medium circulation circuit does not change immediately. That is, the heat medium functions as a buffer. Therefore, the controller 63*b* having received the stop information of the heat-source device 1 continues the operation of the second relay unit 3*b* regardless of the operation states of the heat-source device 1 and the first relay unit 3*a*. This operation is continued while the temperature of the heat medium (the temperature of the heat medium having flowed out of the intermediate heat exchanger 15) detected by the first temperature sensor 31 is within a temperature range capable of the operation. Here, this temperature range capable of the operation corresponds to the second predetermined temperature of this invention, and the first temperature sensor 31 corresponds to the second temperature detection portion.

If the temperature of the heat medium detected by the first temperature sensor 31 deviates from the temperature range capable of operation, the controller 63*b* decreases the flow rate of the pump 21. Then, in the end, the controller 63*b* stops the operation of the second relay unit 3*b*.

The air-conditioning apparatus 100 according to this embodiment is an air-conditioning apparatus capable of performing cooling and heating at the same time. Thus, in the second relay unit 3*b*, the first intermediate heat exchanger 15*a* for a heating operation and the second intermediate heat exchanger 15*b* for a cooling operation are disposed. Therefore, if there is the indoor unit 2 performing the heating operation, the operation of the second relay unit 3*b* is continued while the temperature of the heat medium (temperature of the heat medium having flowed out of the intermediate heat exchanger 15*a*) detected by the first temperature sensor 31*a* is within a temperature range capable of the operation. Also, if there is the indoor unit 2 performing the cooling operation, the operation of the second relay unit 3*b* is continued while the temperature of the heat medium (temperature of the heat medium having flowed out of the intermediate heat exchanger 15*b*) detected by the first temperature sensor 31*b* is within a temperature range capable of the operation. That is, in this embodiment, there are two second predetermined temperature ranges, which are different temperature ranges.

In this embodiment, continuation/stoppage of the operation of the second relay unit is determined on the basis of the temperature detected by the first temperature sensor 31, but continuation/stoppage of the operation of the second relay unit may be determined by the other temperature sensors or the like. For example, continuation/stoppage of the operation of the second relay unit may be determined by using the second temperature sensor 32 that detects the temperature of the heat medium flowing into the intermediate heat exchanger 15. For example, if there is the indoor unit 2 performing an operation, continuation/stoppage of the operation of the second relay unit may be determined by the third temperature sensor 33 that detects the temperature of the heat medium flowing into the use side heat exchanger 26 of this indoor unit 2 or the fourth temperature sensor 34 that detects the temperature of the heat medium flowing out of the use side heat exchanger 28 of this indoor unit 2.

Even if the heat-source device 1 is stopped, the heat medium at the temperature capable of the operation is supplied from the second relay unit 3*b* to the indoor unit 2. Thus, the controller 62 having received the stop information of the heat-source device 1 continues the operation of the indoor unit 2 regardless of the operation states of the heat-source device 1, the first relay unit 3*a* and the second relay unit 3*b*. This operation is continued while the temperature of the heat medium (temperature of the heat medium flowing into the use side heat exchanger 26) detected by the third temperature sensor 33 is within a range capable of the operation. Here, this temperature range capable of the operation corresponds to the first predetermined temperature of the present invention, and the third temperature sensor 33 corresponds to the first temperature detection portion.

If the temperature of the heat medium detected by the third temperature sensor 33 deviates from the temperature range capable of the operation, the controller 62 stops the operation of the indoor unit. An air amount of the fan of the indoor unit 2 may be limited for a period till the operation of the indoor unit 2 is stopped after the temperature detected by the third temperature sensor 33 deviates from the temperature range capable of the operation. If the living space 7 is being heated, for example, a feeling of cold and discomfort felt by a use can be suppressed.

The indoor unit 2 according to this embodiment is capable of the cooling operation and the heating operation. Thus, in this embodiment, there are the first predetermined temperature range during the cooling operation and the first predetermined temperature range during the heating operation.

Also, continuation/stoppage of the operation of the indoor unit 2 is determined on the basis of the temperature detected by the third temperature sensor 33 in this embodiment, but continuation/stoppage of the operation of the indoor unit 2 may be determined by the other temperature sensors and the like. For example, continuation/stoppage of the operation of the indoor unit 2 may be determined by using the fourth temperature sensor 34 that detects the temperature of the heat medium flowing out of the use side heat exchanger 26. For example, a temperature sensor that detects the temperature of the heat medium flowing into the use side heat exchanger 26 or the heat medium flowing out of the use side heat exchanger may be disposed in the indoor unit 2 so as to determine continuation/stoppage of the operation of the indoor unit 2 by using this temperature sensor.

(If the Controller 63*a* of the First Relay Unit 3*a* Detects an Abnormality)

If the controller 63*a* detects an operation abnormality of the expansion valve 16*e* and the like, an operation abnormality of a heat-source refrigerant (a pressure abnormality, a temperature abnormality or the like) in the refrigeration cycle device or the like, the controller stops the operation of the first relay unit 3*a*.

The heat-source device 1 and the first relay unit 3*a* perform operations in conjunction with each other. Thus, the controller 61 having received stop information of the first relay unit 3*a* stops the operation of the heat-source device 1.

The controller 61 and the controller 63*a* try resuming of operations of the heat-source device 1 and the first relay unit 3*a* after a predetermined time has elapsed. This resuming of operation trial is repeated a predetermined number of times. That is because the abnormality detected by the controller 63*a* might be a transient abnormality (noise, an abnormality which occurs in a transition state before a stable operation is established or the like). If the controller 63*a* still detects an abnormality even after the resuming of operation trial is repeated a predetermined number times, the controller 61 and the controller 63*a* stop the heat-source device 1 and the first relay unit 3*a* for the abnormality.

Even if the first relay unit 3*a* is stopped (even if the flow of the refrigerant in the refrigeration cycle is stopped), as described above, the heat medium functions as a buffer. Therefore, the controller 63*b* having received the stop information of the first relay unit 3*a* continues the operation of the second relay unit 3*b* regardless of the operation states of the heat-source device 1 and the first relay unit 3*a*. This operation is continued while the temperature of the heat medium (the temperature of the heat medium having flowed out of the intermediate heat exchanger 15) detected by the first temperature sensor 31 is within a temperature range capable of the operation. If the temperature of the heat medium detected by the first temperature sensor 31 deviates from the temperature range capable of the operation, the controller 63*b* decreases the flow rate of the pump 21. And finally, the controller 63*b* stops the operation of the second relay unit 3*b*.

Even if the first relay unit 3*a* is stopped, the heat medium at a temperature capable of the operation is supplied from the second relay unit 3*b*. Therefore, the controller 62 having received the stop information of the first relay unit 3*a* continues the operation of the indoor unit 2 regardless of the operation states of the heat-source device 1, the first relay unit 3*a* and the second relay unit 3*b*. This operation is continued while the temperature of the heat medium (the temperature of the heat medium flowing into the use side heat exchanger 26) detected by the third temperature sensor 33 is within a range capable of the operation. If the temperature of the heat medium detected by the third temperature sensor 33 deviates from the temperature range capable of the operation, the controller 62 stops the operation of the indoor unit. An air amount of the fan of the indoor unit 2 may be limited for a period till the operation of the indoor unit 2 is stopped after the temperature detected by the third temperature sensor 33 deviates from the temperature range capable of the operation. As a result, if the living space 7 is being heated, for example, a feeling of cold and discomfort felt by a user can be suppressed.

(If the Controller 63*b* of the Second Relay Unit 3*b* Detects an Abnormality)

If the controller 63*b* detects an operation abnormality of the pump 21, the expansion valves 16*a* to 16*d*, the channel switching valve 22, the channel switching valve 23, the stop valve 24, the flow control valve 25 and the like, an operation abnormality of a heat-source refrigerant (a pressure abnormality, a temperature abnormality or the like) in the refrigeration cycle device or the like, the controller 63*b* stops the operation of the second relay unit 3*b*.

The heat-source device 1 and the first relay unit 3*a* perform operations in conjunction with the second relay unit 3*b*. Thus, the controller 61 and the controller 63*a* having received stop information of the second relay unit 3*b* stops the operations of the heat-source device 1 and the first relay unit 3*a*.

The controller 61, the controller 63*a*, and the controller 63*b* try resuming of operations of the heat-source device 1, the first relay unit 3*a*, and the second relay unit 3*b* after a predetermined time has elapsed. This resuming of operation trial is repeated a predetermined number of times. That is because the abnormality detected by the controller 63*b* might be a transient abnormality (noise, an abnormality which occurs in a transition state before a stable operation is established or the like). If the controller 63*b* still detects an abnormality even after the resuming of operation trial is repeated a predetermined number times, the controller 61, the controller 63*a*, and the controller 63*b* stop the heat-source device 1, the first relay unit 3*a*, and the second relay unit 3*b* for the abnormality.

Even if the second relay unit 3*b* is stopped, the heat medium functions as a buffer. Therefore, the controller 62 having received the stop information of the second relay unit 3*b* continues the operation of the indoor unit 2 regardless of the operation states of the heat-source device 1, the first relay unit 3*a*, and the second relay unit 3*b*. This operation is continued while the temperature of the heat medium (the temperature of the heat medium flowing into the use side heat exchanger 26) detected by the third temperature sensor 33 is within a temperature range capable of the operation. If the temperature of the heat medium detected by the third temperature sensor 33 deviates from the temperature range capable of the operation, the controller 62 stops the operation of the indoor unit. An air amount of the fan of the indoor unit 2 may be limited for a period till the operation of the indoor unit 2 is stopped after the temperature detected by the third temperature sensor 33 deviates from the temperature range capable of the operation. As a result, if the living space 7 is being heated, for example, a feeling of cold and discomfort felt by a user can be suppressed.

(If the Controller 62 of the Indoor Unit 2 Detects an Abnormality)

If the controller 62 detects an operation abnormality of the fan and the like and an operation abnormality of the heat medium (a pressure abnormality, a temperature abnormality and the like) in the heat-medium circulation circuit, the controller stops the operation of the indoor unit 2. The heat-source device 1, the first relay unit 3*a*, and the second relay unit 3*b* perform operations in conjunction with each other. Thus, the controller 61, the controller 63*a*, and the indoor unit 2 having received stop information of the indoor unit 2 stops the operations of the heat-source device 1, the first relay unit 3*a* and the second relay unit 3*b*.

The controller 61, the controller 63*a*, the controller 63*b*, and the controller 62 try resuming of operations of the heat-source device 1, the first relay unit 3*a*, the second relay unit 3*b*, and the indoor unit 2 after a predetermined time has elapsed. This resuming of operation trial is repeated a predetermined number of times. That is because the abnormality detected by the controller 62 might be a transient abnormality (noise, an abnormality which occurs in a transition state before a stable operation is established or the like). If the controller 62 still detects an abnormality even after the resuming of operation trial is repeated a predetermined number times, the controller 61, the controller 63*a*, the controller 63*b*, and the controller 62 stop the heat-source device 1, the first relay unit 3*a*, the second relay unit 3*b*, and the indoor unit 2 for the abnormality.

[If a Communication Abnormality Occurs Between Controllers]

If a communication abnormality occurs between each controller (the controller 61, the controller 63*a*, the controller 63*b*, and the controller 62) during the operation of the air-conditioning apparatus 100, each unit constituting the air-conditioning apparatus 100 operates as follows so as to delay stoppage of the indoor unit 2.

(Indoor Unit 2)

In the case of the communication abnormality between the controller 62 and the other controllers, the controller 62 continues the operation of the indoor unit 2 in the state before the communication abnormality occurred. This operation is continued while the temperature of the heat medium (the temperature of the heat medium flowing into the use side heat exchanger 26) detected by the third temperature sensor 33 is within a temperature range capable of the operation. If the temperature of the heat medium detected by the third temperature sensor 33 deviates from the temperature range capable of the operation, the controller 62 stops the operation of the indoor unit. An air amount of the fan of the indoor unit 2 may be limited for a period till the operation of the indoor unit 2 is stopped after the temperature detected by the third temperature sensor 33 deviates from the temperature range capable of the operation. As a result, if the living space 7 is being heated, for example, a feeling of cold and discomfort felt by a user can be suppressed.

(Second Relay Unit 3*b*)

In the case of the communication abnormality between the controller 63*b* and the other controllers, the controller 63*b* continues the operation of the second relay unit 3*b* in the state before the communication abnormality occurred. This operation is continued while the temperature of the heat medium (the temperature of the heat medium having flowed out of the intermediate heat exchanger 15) detected by the first temperature sensor 31 is within a temperature range capable of the operation. If the temperature of the heat medium detected by the first temperature sensor 31 deviates from the temperature range capable of the operation, the controller 63*b* decreases the flow rate of the pump 21. Finally, the controller 63*b* stops the operation of the second relay unit 3*b*.

Also, even if the temperature of the heat medium detected by the first temperature sensor 31 is within the temperature range capable of the operation, if a discharge pressure of the pump 21 deviates from a predetermined pressure range, the controller 63*b* stops the operation of the second relay unit 3*b*. That is because the heat medium is in the state not able to circulate in the heat-medium circulation circuit such that all the indoor units 2 are in the stopped state.

(First Relay Unit 3*a*)

In the case of the communication abnormality between the controller 63*a* and the other controllers, the controller 63*a* continues operation of the first relay unit 3*a* in the state before the communication abnormality occurred. This operation is continued on the basis of the pressures detected by the pressure sensor 39 and the pressure sensor 40. In other words, the relay unit 3*a* is operated on the basis of the pressure on the high-pressure side and the pressure on the low pressure side of the heat-source-side refrigerant flowing through the refrigeration cycle. The operation of the relay unit 3*a* is continued while values detected by the pressure sensor 39 and the pressure sensor 40 are within a predetermined pressure range. If the values detected by the pressure sensor 39 and the pressure sensor 40 get out of the predetermined pressure range, the controller 63*a* judges that the heat-source-side refrigerant operation in the refrigeration cycle is not normal and stops the operation of the first relay unit 3*a*. Here, this predetermined pressure range is the second predetermined pressure range. The controller 63*a* may continue the operation of the first relay unit 3*a* on the basis of one of the detected pressures of the pressure sensor 39 and the pressure sensor 40.

(Heat-Source Device 1)

In the case of the communication abnormality between the controller 61 and the other controllers, the controller 61 continues the operation of the heat-source device 1 in the state before the communication abnormality occurred. This operation is continued while the detected values of the pressure sensor 39 and the pressure sensor 40 are within the predetermined pressure range. If the detected values of the pressure sensor 39 and the pressure sensor 40 get out of the predetermined pressure range, the controller 63*a* determines that the heat-source-side refrigerant operation in the refrigeration cycle is not normal and stops the operation of the heat-source device 1. The controller 61 may continue the operation of the heat-source device 1 on the basis of one of the detected pressures of the pressure sensor 39 and the pressure sensor 40.

If the communication between each controller is recovered before all the units are stopped, each controller resumes the operation of each unit in the set operation state (if the operation state is stop, the unit is stopped).

If an operation instruction is inputted into the controller 62 of the indoor unit 2 in a state in which all the units are stopped and the communication abnormality between each controller is not recovered, the controller 62 and the controller 63*a* try resuming of operation of the indoor unit 2 and the second relay unit 3*a*. At this time, the indoor unit 2 and the second relay unit 3*a* try the operation in the default state. In this embodiment, considering the server room and the like, the cooling operation is set as default. The operation instruction is inputted in the order of the indoor unit 2, the second relay unit 3*b*, the first relay unit 3*a*, and the heat-source device 1. Thus, if the communication abnormality occurs between the controller 62 and the controller 63*a*, the resuming of operation of the second relay unit 3*a* is not performed. Also, the resuming of operation of the second relay unit 3*a* is performed after a predetermined time has elapsed after the resuming of operation of the indoor unit 2. By performing the resuming of operation as above, occurrence of a pressure abnormality in the refrigeration cycle and the heat-medium circulation circuit can be suppressed. In this embodiment, the cooling operation is set as default, but it is needless to say that the heating operation may be set as default.

As described above, the air-conditioning apparatus according to this embodiment continues the operation of the indoor unit 2 even if an abnormality in at least any one of the heat-source device 1, the first relay unit 3*a* and the second relay unit 3*b* is detected. This operation is continued while the temperature of the heat medium (temperature of the heat medium flowing into the use side heat exchanger 26) detected by the third temperature sensor 33 is within a temperature range capable of the operation. Thus, even if an abnormality is detected in at least any one of the heat-source device 1, the first relay unit 3*a* and the second relay unit 3*b*, stoppage of the indoor unit 2 can be delayed.

Also, even if an abnormality is detected in at least one of the heat-source device 1 and the first relay unit 3*a*, the operation of the second relay unit is continued. This operation is continued while the temperature of the heat medium (temperature of the heat medium having flowed out of the intermediate heat exchanger 15) detected by the first temperature sensor 31 is within a temperature range capable of the operation. Thus, the heat medium can be supplied to the indoor unit 2, and stoppage of the indoor unit 2 can be further delayed.

Also, the unit (the heat-source device 1, the first relay unit 3*a*, the second relay unit 3*b*, and the indoor unit 2) stopped since an abnormality was detected tries resuming of operation after a predetermined time has elapsed. This resuming of operation trial is repeated a predetermined number of times. Thus, if the detected abnormality is transient, the unit stopped since an abnormality was detected can be re-operated.

Also, in the case of the communication abnormality between the controller 62 and the other controllers, the controller 62 continues the operation of the indoor unit 2 in the state before the communication abnormality occurred. This operation is continued while the temperature of the heat medium (the temperature of the heat medium flowing into the use side heat exchanger 26) detected by the third temperature sensor 33 is within a temperature range capable of the operation. Thus, even in the case of a communication abnormality between the controller 62 and the other controllers, stoppage of the indoor unit 2 can be delayed.

Also, in the case of the communication abnormality between the controller 63*b* and the other controllers, the controller 63*b* continues the operation of the second relay unit 3*b* in the state before the communication abnormality occurred. This operation is continued while the temperature of the heat medium (the temperature of the heat medium having flowed out of the intermediate heat exchanger 15) detected by the first temperature sensor 31 is within a temperature range capable of the operation. Thus, the heat medium can be supplied to the indoor unit 2, and stoppage of the indoor unit 2 can be further delayed.

Also, even if the temperature of the heat medium detected by the first temperature sensor 31 is within the temperature range capable of the operation, if the discharge pressure of the pump 21 gets out of the predetermined pressure range, the controller 63*b* stops the operation of the second relay unit 3*b*. Thus, a failure or the like of the pump 21 caused by an excessive load can be prevented, and reliability of the air-conditioning apparatus 100 is improved.

Also, in the case of a communication abnormality between the controller 63*a* and the other controllers, the controller 63*a* continues the operation of the first relay unit 3*a* in the state before the communication abnormality occurred. This operation is continued on the basis of the detected pressures of the pressure sensor 39 and the pressure sensor 40.

Similarly, in the case of a communication abnormality between the controller 61 and the other controllers, the controller 61 continues the operation of the heat-source device 1 in the state before the communication abnormality occurred. This operation is continued while the detected values of the pressure sensor 39 and the pressure sensor 40 are within a predetermined pressure range.

Thus, heat exchange between the heat-source refrigerant and the heat medium in the intermediate heat exchanger is made possible, and stoppage of the indoor unit 2 can be further delayed.

Also, if an operation instruction is inputted in a state in which all the units are stopped while a communication abnormality between each controller is not recovered, the controller 62 and the controller 63*a* try resuming of operation of the indoor unit 2 and the second relay unit 3*a*. At this time, the indoor unit 2 and the second relay unit 3*a* are operated in the default state. Thus, the air condition of the living space 7 can be controlled so that it does not worsen.

In this embodiment, the controller is disposed in each unit, but some of or all of the controllers may be constituted as a single controller. For example, an operation of each unit when an abnormality in each device disposed in the unit is detected can be also controlled in the same way if each unit is controlled by one controller. For example, for an operation in each unit in the case of a communication abnormality between the controllers, it is only necessary that a controller is disposed in a unit whose operation is to be continued independently (the indoor unit 2, for example).

The invention claimed is:

1. An air-conditioning apparatus, comprising:

at least one indoor unit;

at least one relay unit;

a refrigerant cycle for a refrigerant including a compressor, a four way valve and a heat exchanger that supplies the refrigerant that changes in two phases or is in a supercritical state to the at least one relay unit wherein the at least one relay unit is configured to exchange heat between the refrigerant from the refrigerant cycle and a heat medium such as water or anti-freezing fluid different from the refrigerant in an intermediate heat exchanger and supplies the heat medium to the at least one indoor unit, and the at least one indoor unit that is configured to exchange heat between the heat medium supplied from the relay unit and air of a region to be air-conditioned in a use side heat exchanger and perform cooling or heating in the region to be air-conditioned;

a microcomputer arranged as a controller and configured to control operation of the refrigerant cycle, the relay unit and the indoor unit; and a first temperature detection portion that detects the temperature of the heat medium flowing through the use side heat exchanger, wherein if an operational parameter of at least either the refrigerant cycle or the relay unit occurs that is determined by the controller to be outside of a normal operational parameter such that the controller is configured to stop the refrigerant cycle or the at least one relay unit, the controller is configured to continue the operation of the indoor unit while the temperature detected by the first temperature detection portion remains within a first predetermined temperature range, and stop the operation of the indoor unit if the temperature detected by the first temperature detection portion is not within the first predetermined temperature range.

2. The air-conditioning apparatus of claim 1, wherein the relay unit is provided with a second temperature detection portion that detects the temperature of the heat medium flowing through the intermediate heat exchanger; and if an operational parameter in the refrigerant cycle is detected that is outside of the normal operational parameter of the refrigerant cycle, the controller is configured to continue the operation of the relay unit while the temperature detected by the second temperature detection portion remains within a second predetermined temperature range.

3. The air-conditioning apparatus of claim 1, wherein the controller is configured to perform an instruction of resumption of an operation for a predetermined number of times to any of the refrigerant cycle, the relay unit, and the indoor unit, in which the operational parameter that is outside the normal operational parameter is detected.

4. The air-conditioning apparatus of claim 2, the at least one relay unit further comprising:

a first relay unit that distributes and supplies the refrigerant supplied from the refrigerant cycle; and at least one second relay unit that exchanges heat between the refrigerant supplied from the first relay unit and the heat medium in the intermediate heat exchanger and supplies the heat medium to the at least one indoor unit, the air-conditioning apparatus wherein:

the second temperature detection portion is disposed in the second relay unit; and if an operational parameter that is outside a normal operational parameter is detected in at least either the refrigerant cycle or the first relay unit, the controller is configured to continue the operation of the second relay unit while the temperature detected by the second temperature detection portion remains within the second predetermined temperature range.

5. The air-conditioning apparatus of claim 4, wherein the controller is configured to perform an instruction of resumption of an operation for a predetermined number of times to any of the refrigerant cycle, the first relay unit, the second relay unit, and the indoor unit, in which the operational parameter that is outside a normal operational parameter is detected.

6. An air-conditioning apparatus comprising:

at least one indoor unit;

at least one relay unit;

a refrigerant cycle for a refrigerant including a compressor, a four way valve and a heat exchanger that supplies the refrigerant that changes in two phases or is in a supercritical state to the at least one relay unit; wherein the at least one relay unit is configured to exchange heat between the refrigerant from the refrigerant cycle and a heat medium such as water or anti-freezing fluid different from the refrigerant in an intermediate heat exchanger and supplies the heat medium to the at least one indoor unit, and the at least one indoor unit is configured to exchange heat between the heat medium supplied from the relay unit and air of a region to be air-conditioned in a use side heat exchanger and perform cooling or heating in the region to be air-conditioned;

a microcomputer arranged as a first controller and configured to control operation of the refrigerant cycle and the relay unit;

a microcomputer arranged as a second controller, and configured to control operation of the indoor unit; and a first temperature detection portion that detects the temperature of the heat medium that flows through the use side heat exchanger, wherein if an abnormality occurs in communication between the first controller and the second controller, the second controller is configured to continue the operation of the indoor unit while the temperature detected by the first temperature detection portion remains within a first predetermined temperature range.

7. The air-conditioning apparatus of claim 6, wherein when an operation instruction is inputted to the second controller in a state in which the indoor unit is stopped, the second controller is configured to perform the operation of the indoor unit with a default setting if an abnormality occurs in the communication with the first controller.

8. The air-conditioning apparatus of claim 6, the relay unit further comprising:

a second temperature detection portion that detects the temperature of the heat medium flowing through the intermediate heat exchanger, the first controller further comprising a third controller configured to control the operation of the refrigerant cycle and a fourth controller configured to control the operation of the relay unit, the air-conditioning apparatus wherein if an abnormality occurs in communication between the fourth controller and at least either the second controller or the third controller, the fourth controller is configured to continue the operation of the relay unit while the temperature detected by the second temperature detection portion remains within a second predetermined temperature range.

9. The air-conditioning apparatus of claim 8, wherein if a discharge pressure of a pump that supplies the heat medium reaches a predetermined pressure or more, the fourth controller is configured to stop the operation of the relay unit.

10. The air-conditioning apparatus of claim 9, wherein if an abnormality occurs in communication between the third controller and at least either the second controller or the fourth controller, the third controller is configured to continue the operation of the refrigerant cycle while the pressure of the refrigerant remains within the predetermined pressure range.

11. The air-conditioning apparatus of claim 8, wherein when an operation instruction is inputted to the fourth controller in a state in which the relay unit is stopped, the fourth controller is configured to perform the operation of the relay unit with a default setting if an abnormality occurs in the communication with the third controller.

12. The air-conditioning apparatus of claim 8, the relay unit further comprising:

a first relay unit that supplies the refrigerant supplied from the refrigerant cycle; and at least one second relay unit that exchanges heat between the refrigerant supplied from the first relay unit and the heat medium in the intermediate heat exchanger and supplies the heat medium, the fourth controller further comprising a fifth controller configured to control the operation of the first relay unit and a sixth controller configured to control the operation of the second relay unit, the air-conditioning apparatus wherein if an abnormality occurs in communication between the sixth controller and at least one of the second controller, the third controller and the fifth controller, the sixth controller is configured to continue the operation of the second relay unit while the temperature detected by the second temperature detection portion remains within the second predetermined temperature range.

13. The air-conditioning apparatus of claim 12, wherein if a discharge pressure of a pump that supplies the heat medium reaches a predetermined pressure or more, the sixth controller is configured to stop the operation of the second relay unit.

14. The air-conditioning apparatus of claim 13, wherein if an abnormality occurs in communication between the fifth controller and at least one of the second controller, the third controller, and the sixth controller, the fifth controller is configured to continue the operation of the first relay unit while the pressure of the refrigerant remains within the predetermined pressure range.

15. The air-conditioning apparatus of claim 12, wherein when an operation instruction is inputted to the sixth controller in a state in which the second relay unit is stopped, the sixth controller is configured to perform the operation of the second relay unit with a default setting if an abnormality occurs in the communication with at least one of the third controller and the fifth controller.

* * * * *